US009968235B2

(12) United States Patent
Vail et al.

(10) Patent No.: US 9,968,235 B2
(45) Date of Patent: May 15, 2018

(54) FLOOR CLEANING MACHINE INCLUDING A SANITIZE MODE

(71) Applicant: Techtronic Floor Care Technology Limited, Road Town, Torotola (VG)

(72) Inventors: Kevin Vail, North Royalton, OH (US); Patrick J. Quinn, North Canton, OH (US); Robert A. Salo, Mentor, OH (US); John R. Bantum, Munroe Falls, OH (US); Lucas W. Phalen, Streetsboro, OH (US); Gino S. Lovano, Strongsville, OH (US); Phonesacksith G. Kettavong, Kent, OH (US); Brent Noward, Akron, OH (US); Kyle J. Wheaton, Edina, MN (US)

(73) Assignee: Techtronic Floor Care Technologies Limited, Tortola (VG)

( * ) Notice: Subject to any disclaimer, the term of this patent is extended or adjusted under 35 U.S.C. 154(b) by 1013 days.

(21) Appl. No.: 13/827,273

(22) Filed: Mar. 14, 2013

(65) Prior Publication Data

US 2014/0259514 A1 Sep. 18, 2014

(51) Int. Cl.
*A47L 7/00* (2006.01)
*A47L 11/40* (2006.01)
(Continued)

(52) U.S. Cl.
CPC ..... *A47L 11/4044* (2013.01); *A47L 9/02* (2013.01); *A47L 9/2842* (2013.01); *A47L 11/29* (2013.01);
(Continued)

(58) Field of Classification Search
USPC ..... 15/319, 320, 321
See application file for complete search history.

(56) References Cited

U.S. PATENT DOCUMENTS 5,500,977 A 3/1996 McAllise et al.
5,761,763 A 6/1998 McAllise et al.
(Continued)

FOREIGN PATENT DOCUMENTS

GB 2377624 A 1/2003
WO 2007095072 8/2007

OTHER PUBLICATIONS

International Search Report and Written Opinion for Application No. PCT/US2014/026186 dated Oct. 9, 2014 (16 pages).
(Continued)

*Primary Examiner* — Joseph J Hail
*Assistant Examiner* — Shantese McDonald
(74) *Attorney, Agent, or Firm* — Michael Best & Friedrich LLP

(57) ABSTRACT

A floor cleaning machine for cleaning a surface includes a body, a distribution nozzle supported by the body, a supply tank assembly coupled to the body in fluid communication with the distribution nozzle, a suction nozzle supported by the body, and a suction source in fluid communication with the suction nozzle. The suction source is operable to draw fluid and dirt from the surface through the suction nozzle. The floor cleaning machine also includes a recovery tank coupled to the body in fluid communication with the suction source to receive and store fluid and dirt drawn through the suction nozzle. The floor cleaning machine is operable in a first mode to wash the surface and is operable in a second mode to sanitize the surface.

27 Claims, 15 Drawing Sheets

(51) Int. Cl.

| | |
|---|---|
| ***A47L 9/02*** | (2006.01) |
| ***A47L 9/28*** | (2006.01) |
| ***A47L 11/29*** | (2006.01) |
| ***A47L 11/34*** | (2006.01) |

(52) U.S. Cl.

CPC ..... *A47L 11/34* (2013.01); *A47L 11/408* (2013.01); *A47L 11/4011* (2013.01); *A47L 11/4036* (2013.01); *A47L 11/4038* (2013.01); *A47L 11/4055* (2013.01); *A47L 11/4058* (2013.01); *A47L 11/4072* (2013.01); *A47L 11/4083* (2013.01); *A47L 11/4088* (2013.01)

(56) References Cited

U.S. PATENT DOCUMENTS

| | | | | |
|---|---|---|---|---|
| 5,867,857 | A | 2/1999 | Crouser et al. | |
| 5,901,406 | A | 5/1999 | Mueller et al. | |
| 6,009,593 | A | 1/2000 | Crouser et al. | |
| 6,066,348 | A | 5/2000 | Yuan et al. | |
| 6,105,203 | A | 8/2000 | Hueppi et al. | |
| 6,189,174 | B1 | 2/2001 | Crouser et al. | |
| 6,192,548 | B1 * | 2/2001 | Huffman | A47L 5/225 15/320 |
| 6,368,373 | B1 | 4/2002 | Mueller | |
| 7,819,127 | B1 * | 10/2010 | Huffman | A47L 11/34 134/198 |
| 8,016,996 | B2 * | 9/2011 | Field et al. | 205/746 |
| 8,381,352 | B2 | 2/2013 | Huffman et al. | |
| 2003/0014829 | A1 | 1/2003 | Wang | |
| 2005/0022333 | A1 | 2/2005 | McDowell et al. | |
| 2006/0101604 | A1 * | 5/2006 | Frederick | A47L 5/30 15/319 |
| 2010/0251505 | A1 * | 10/2010 | Vrdoljak et al. | 15/320 |
| 2012/0260948 | A1 * | 10/2012 | Balas et al. | 134/21 |

OTHER PUBLICATIONS

ProHeat Clear View User's Guide, 1966 Series—120V, 8905 Series—120V, Bissell Homecare, Inc., 2002, 24 pages.

Oreck XL Shield Power Scrubber M900 User's Guide, Oreck Holdings, LLC., 2008, 8 pages.

European Patent Office Action for Application No. 14722853.0 dated Feb. 20, 2017 (4 pages).

Chinese Patent Office Action for Application No. 201480026673.2 dated Sep. 30, 2016 (19 pages).

* cited by examiner

FLOOR CLEANING MACHINE INCLUDING A SANITIZE MODE

BACKGROUND

The present invention relates to floor cleaning machines and, more particularly, to floor cleaning machines having multiple modes of operation.

A floor cleaning machine, such as an extractor, typically sprays or otherwise distributes cleaning fluid onto a surface to wash the surface. The machine then draws the cleaning fluid and dirt from the surface into a recovery tank. Some floor cleaning machines can also deliver water to the surface to rinse the surface before and/or after the cleaning fluid is applied.

SUMMARY

In one embodiment, the invention provides a floor cleaning machine for cleaning a surface. The floor cleaning machine includes a body, a distribution nozzle supported by the body, a supply tank assembly coupled to the body in fluid communication with the distribution nozzle, a suction nozzle supported by the body, and a suction source in fluid communication with the suction nozzle. The suction source is operable to draw fluid and dirt from the surface through the suction nozzle. The floor cleaning machine also includes a recovery tank coupled to the body in fluid communication with the suction source to receive and store fluid and dirt drawn through the suction nozzle. The floor cleaning machine is operable in a first mode to wash the surface and is operable in a second mode to sanitize the surface.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
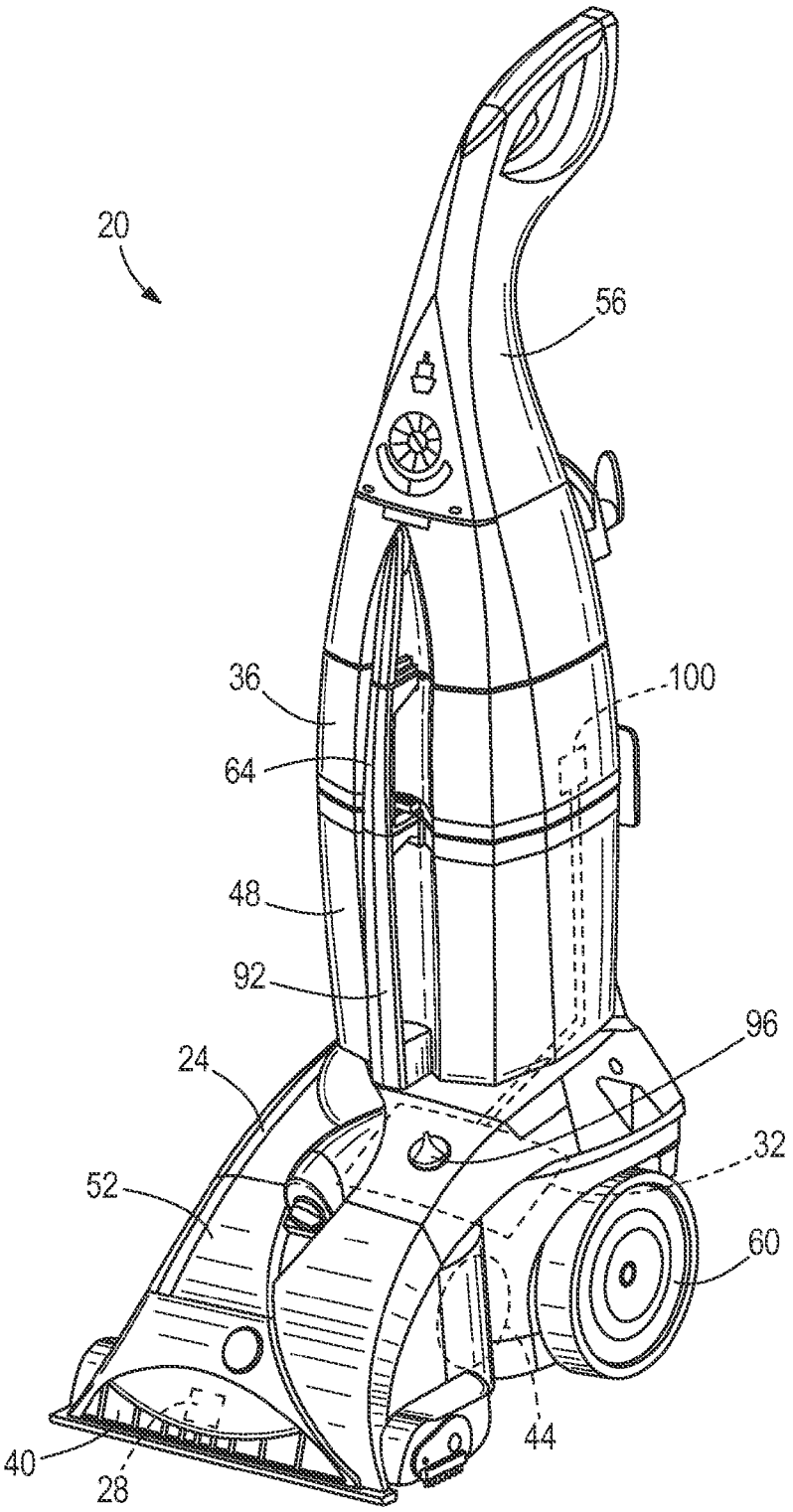
FIG. 1 is a perspective view of a floor cleaning machine.

FIG. 1 illustrates a floor cleaning machine 20, such as an extractor. In the illustrated embodiment, the extractor 20 is an upright extractor operable to a clean a surface, such as, for example, a floor. In some embodiments, the extractor 20 may be adapted to clean a variety of surfaces, such as carpets, hardwood floors, tiles, or the like. The extractor 20 distributes or sprays cleaning fluid onto the surface to clean the surface. The extractor 20 then draws the cleaning fluid and any dirt off of the surface, leaving the surface relatively clean and dry. As used herein, "cleaning fluid" refers to a detergent, a sanitizer, or a mixture of water and detergent/sanitizer.

The extractor 20 is capable of operating in multiple modes of operation. For example, the extractor 20 can operate in a first mode to wash a surface and in a second mode to sanitize the surface. In the first or wash mode, the extractor 20 delivers a cleaning solution composed of detergent (or a mixture of detergent and water) onto the surface. In this mode, the extractor 20 can lift dirt, mud, stains, and other debris from the surface. In the second or sanitize mode, the extractor 20 delivers a second cleaning solution composed of sanitizer (or a mixture of sanitizer and water) onto the surface. The sanitizer may be, for example, VITAL OXIDE chlorine dioxide sanitizer manufactured by Vital Solutions LLC. In other embodiments, the sanitizer may be a powder or solid that is dissolved in a water tank or a cleaning solution tank of the extractor 20. In the sanitize mode, the extractor 20 can kill bacteria and other types of microorganisms on the surface. When using the extractor 20 in the sanitize mode, the extractor 20 kills at least 90% of microorganisms on the surface. In some embodiments, the extractor 20 kills at least 99% of microorganisms on the surface when operating in the sanitize mode. In further embodiments, the extractor 20 kills at least 99.99% of microorganisms on the surface when operating in the sanitize mode.

In some embodiments, the cleaning solutions used in the wash mode and in the sanitize mode may be the same. In order to achieve different results when using the same cleaning solution, more cleaning solution may be delivered to the surface, a higher concentration of cleaning solution may be delivered to the surface, and/or more cleaning solution may be left on (i.e., not recovered from) the surface during sanitizing, as further discussed below.

In some embodiments, the extractor 20 can further operate in a third mode to rinse the surface. In the third or rinse mode, the extractor 20 delivers water onto the surface without detergent or sanitizer. In this mode, the extractor 20 dilutes and washes away residual detergent or sanitizer from the surface.

As shown in FIG. 1, the extractor 20 includes a body 24, a distribution nozzle 28 coupled to the body 24, a distributor 32 coupled to the body 24 in fluid communication with the distribution nozzle 28, a supply tank assembly 36 coupled to the body 24 in fluid communication with the distribution nozzle 28 and the distributor 32, a suction nozzle 40 coupled to the body 24, a suction source 44 coupled to the body 24 in fluid communication with the suction nozzle 40, and a recovery tank 48 coupled to the body 24 in fluid communication with the suction source 44.

In the illustrated embodiment, the body 24 includes a base or foot 52 and a handle 56 pivotally coupled to the foot 52. The foot 52 is movable along a surface to be cleaned and supports the other components of the extractor 20. Two wheels 60 (only one of which is shown) are coupled to the foot 52 to facilitate movement of the foot 52 along the surface. In the illustrated embodiment, the wheels 60 are idle wheels. In other embodiments, the wheels 60 may be driven wheels. The handle 56 extends from the foot 52 and is pivotable between a generally vertical, or upright, storage position shown in FIG. 1) and an infinite number of non-vertical, or inclined, operating positions. Pivoting the handle 56 to one of the operating positions facilitates moving (e.g., pushing and pulling) the foot 52 along the surface.

The distribution nozzle 28 and the suction nozzle 40 are supported by the foot 52 adjacent a lower surface of the foot 52. The distribution nozzle 28 directs cleaning solution from the supply tank assembly 36 onto the surface to be cleaned. The suction nozzle 40 draws fluid and dirt from the surface back into the recovery tank 48 of the extractor 20. In some embodiments, one or more electrically- or pneumatically-actuated brushes may also be supported on the lower surface of the foot 52 adjacent the nozzles 28, 40.

The distributor 32 draws cleaning solution from the supply tank assembly 36 and delivers the cleaning solution onto the surface to be cleaned through the distribution nozzle 28. In some embodiments, the distributor 32 includes a receptacle, a pump, a valve, and conduits connecting the supply tank assembly 36 to the distribution nozzle 28. In other embodiments, the pump may be omitted from the distributor 32 such that cleaning fluid is gravity-fed from the supply tank assembly 36. In the illustrated embodiment, at least a portion of the distributor 32 is supported by and positioned within the foot 52, but may alternatively be positioned elsewhere on the extractor body 24.

Figure 2:
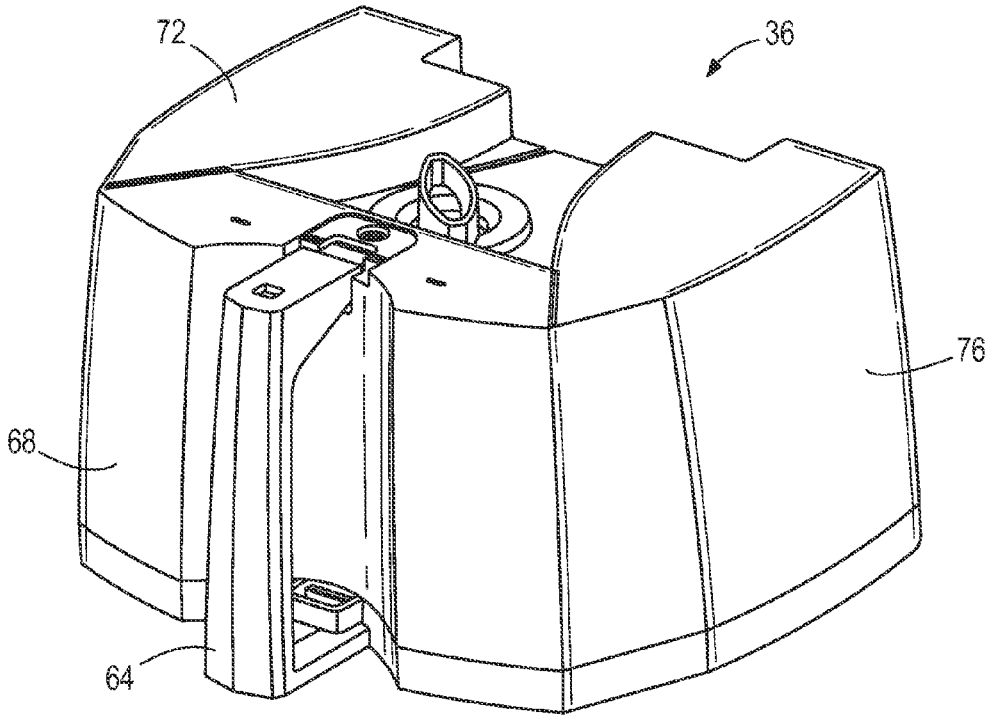
FIG. 2 is a perspective view of a supply tank assembly for use with the floor cleaning machine shown in FIG. 1.
Figure 3:
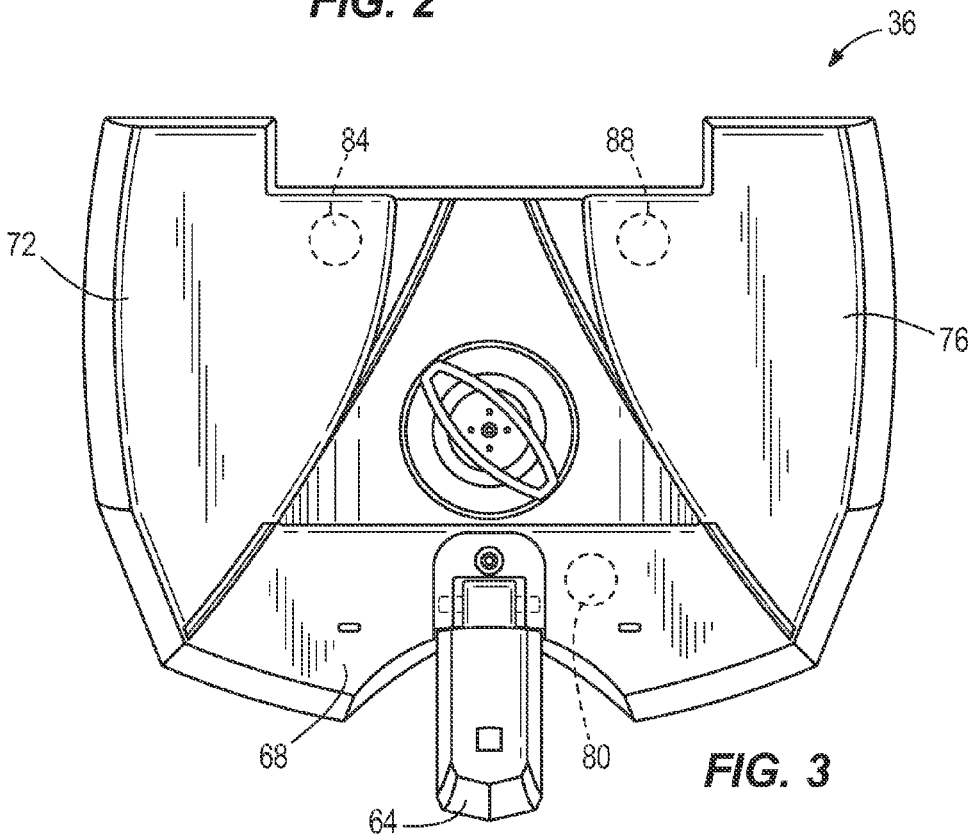
FIG. 3 is a top view of the supply tank assembly of FIG. 2.

The supply tank assembly 36 is removably supported by the handle 56 on top of the recovery tank 48. A handle 64 extends from a front surface of the supply tank assembly 36 to facilitate handling the assembly 36 apart from the extractor body 24. As shown in FIGS. 2 and 3, the illustrated supply tank assembly 36 includes three tanks 68, 72, 76. In the illustrated embodiment, the tanks 68, 72, 76 are integrally formed as a single unit. In other embodiments, the tanks 68, 72, 76 may be separate structures that are permanently or releasably coupled together. The illustrated tanks 68, 72, 76 define discrete volumes for storing cleaning solution and/or water such that the cleaning solutions and water do not mix within the assembly 36. For example, the first tank 68 can store a detergent, the second tank 72 can store a sanitizer, and the third tank 76 can store water. In other embodiments, the water tank 76 can be separate from the supply tank assembly 36 such that the assembly 36 only includes two integrally-formed tanks. Each of the illustrated tanks 68, 72, 76 includes an outlet 80, 84, 88 that communicates with the distributor 32 to draw the corresponding fluid out of the tank 68, 72, 76. The outlets 80, 84, 88 may also be used to refill the tanks 68, 72, 76 when the supply tank assembly 36 is removed from the body 24.

Referring back to FIG. 1, the suction source 44 draws fluid and dirt from the surface being cleaned through the suction nozzle 40 and into the recovery tank 48. In some embodiments, the suction source 44 includes a fan that generates a vacuum to draw the fluid and dirt through the suction nozzle 40. In the illustrated embodiment, the suction source 44 is supported by and positioned within the foot 52, but may alternatively be positioned elsewhere on the extractor body 24.

The recovery tank 48 is removably supported by the handle 56 below the supply tank assembly 36. The recovery tank 48 receives and temporarily stores fluid and dirt drawn up from the surface being cleaned through the suction nozzle 40. When full, the recovery tank 48 may be removed from the body 24 and emptied. A handle 92 extends from a front surface of the recovery tank 48 to facilitate handling the tank 48. In other embodiments, the recovery tank 48 may alternatively be supported elsewhere on the extractor body 24.

The illustrated extractor 20 is operable in three modes: a wash mode, a sanitize mode, and a rinse mode. When in the wash mode, the distributor 32 draws a first cleaning solution from the supply tank assembly 36 (e.g., a detergent from the first tank 68 of the assembly 36). The distributor 32 directs the first cleaning solution to the distribution nozzle 28, which delivers the solution onto the surface being cleaned. When in the sanitize mode, the distributor 32 draws a second cleaning solution from the supply tank assembly 36 (e.g., a sanitizer from the second tank 72 of the assembly 36). The distributor 32 directs the second cleaning solution to the distribution nozzle 28, which delivers the solution onto the surface being cleaned. When in the rinse mode, the distributor 32 draws water from the supply tank assembly 36 (e.g., from the third tank 76 of the assembly 36). The distributor 32 directs the water to the distribution nozzle 28, which delivers the solution onto the surface being cleaned. In some embodiments, water may be drawn from the third tank 76 in all three modes to appropriately dilute the detergent or the sanitizer.

As shown in FIG. 1, the extractor 20 includes an actuator 96 coupled to the body 24. The actuator 96 is a mode selector that allows a user to manually switch between the wash, sanitize, and rinse modes. The illustrated actuator 96 is supported on the foot 52 of the extractor 20, but may alternatively be supported on the handle 56 or on the supply tank assembly 36. In the illustrated embodiment, the actuator 96 includes a rotatable dial. In other embodiments, other suitable actuators may also or alternatively be employed.

The actuator 96 is coupled to the distributor 32 to alter operation of the distributor 32. For example, the actuator 96 may be coupled to a three-way valve 100 of the distributor 32 that is in communication with the three outlets 80, 84, 88 of the tanks 68, 72, 76 (FIGS. 2 and 3). Actuating the actuator 96 between the modes actuates the valve 100 to selectively open the outlets 80, 84, 88. For example, in the wash mode, the outlet 80 of the first tank 68 may be opened, while the outlets 84, 88 of the second and third tanks 72, 76 are closed. In the sanitize mode, the outlet 84 of the second tank 72 may be opened, while the outlets 80, 88 of the first and third tanks 68, 76 are closed. In the rinse mode, the outlet 88 of the third tank 76 may be opened, while the outlets 80, 84 of the first and second tanks are closed 68, 72. In other embodiments, the outlet 88 of the third tank 76 remains open for all the modes and the outlets 80, 84 of the first and second tanks 68, 72 may be selectively closed, depending on the selected mode. In still other embodiments, the extractor 20 may include separate fluid paths for each of the tanks 68, 77, 76.

Figure 4:
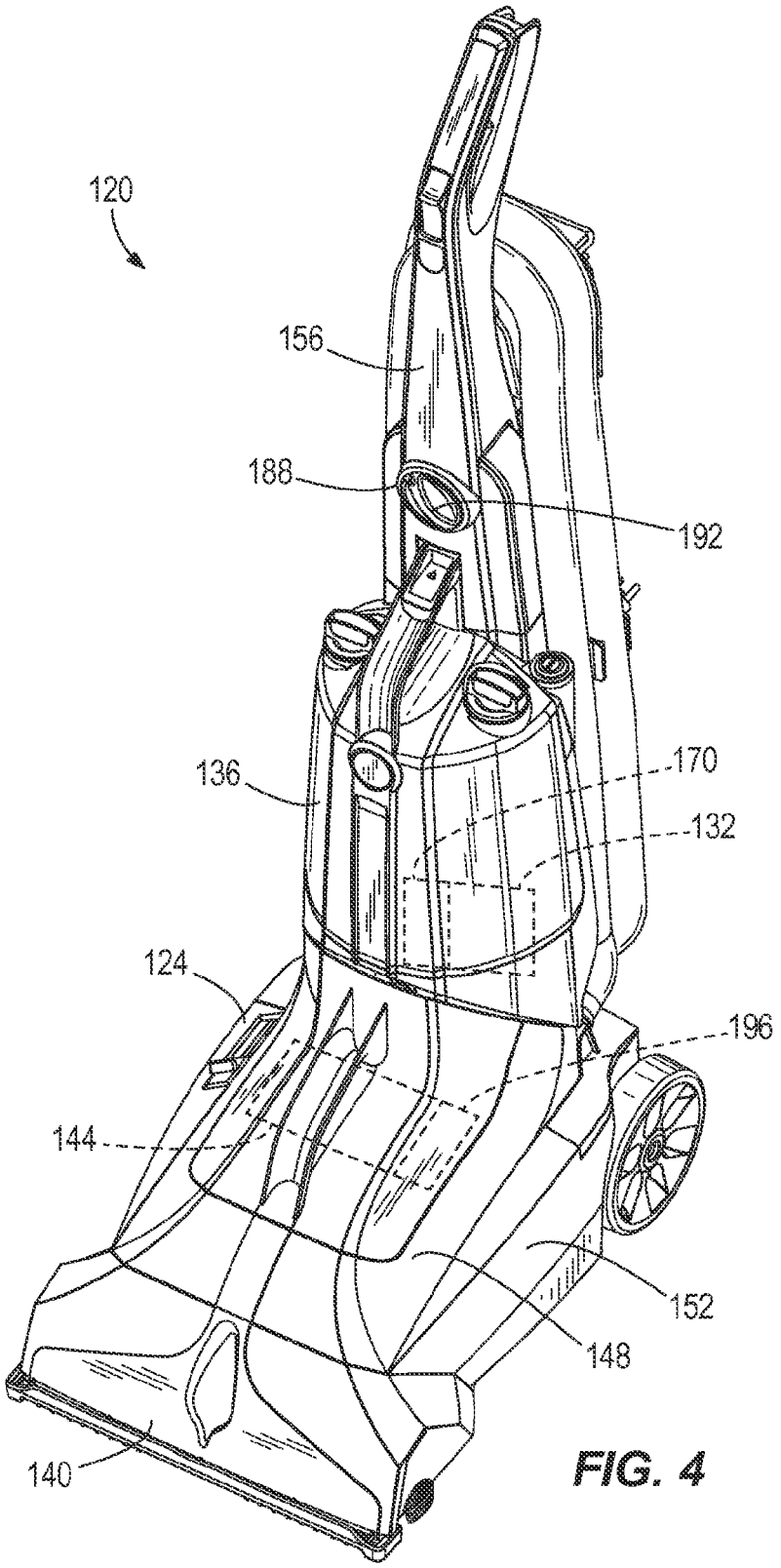
FIG. 4 is a perspective view of another floor cleaning machine.

FIG. 4 illustrates another extractor 120. The illustrated the extractor 120 includes a body 124, a distribution nozzle 128 (FIGS. 5 and 6) coupled to the body 124, a distributor 132 coupled to the body 124 in fluid communication with the distribution nozzle 128, a supply tank assembly 136 coupled to the body 124 in fluid communication with the distribution nozzle 128 and the distributor 132, a suction nozzle 140 coupled to the body 124, a suction source 144 coupled to the body 124 in fluid communication with the suction nozzle 140, and a recovery tank 148 coupled to the body 124 in fluid communication with the suction source 144. The body 124 includes a foot 152 and a handle 156 pivotally coupled to the foot 152. Except as further described below, the components of the extractor 120 generally operate in a similar manner as the components of the extractor 20 discussed above.

In the illustrated embodiment, the supply tank assembly 136 only includes two tanks. The first tank stores a cleaning solution, and the second tank stores water. In such an embodiment, the first tank is filled with a detergent when using the extractor 120 in a wash mode and is filled with a sanitizer when using the extractor 120 in a sanitize mode. In the illustrated embodiment, the supply tank assembly 136 and the distributor 132 are configured to mix detergent or sanitizer from the first tank with water from the second tank on demand. That is, the detergent or sanitizer is mixed with water to create a cleaning solution when the fluids are drawn out of the first tank by the distributor 132 during operation of the extractor 120, rather than being pre-mixed with water inside the supply tank assembly 136.

In operation, the extractor 120 leaves behind more cleaning solution on the surface when in the sanitize mode than when in the wash mode. Leaving more cleaning solution on the surface when in the sanitize mode allows the solution to kill more microorganisms on the surface, thereby sanitizing the surface. The extractor 120 can achieve this result by, for example, adjusting how the cleaning solution is delivered to the surface, reducing the recovery rate or suction efficiency of the extractor 120, and/or increasing the concentration or volume of cleaning solution being delivered onto the surface.

Figure 6:
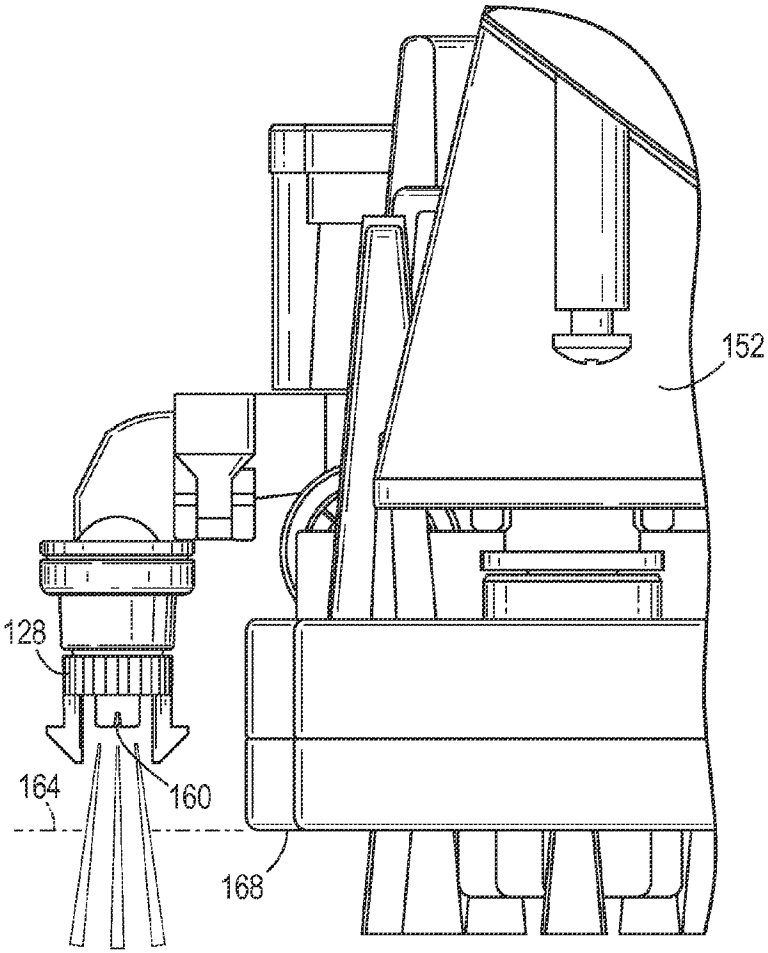
FIG. 6 is a side view of the portion of the floor cleaning machine of FIG. 5 with the distribution nozzle in a second position.
Figure 5:
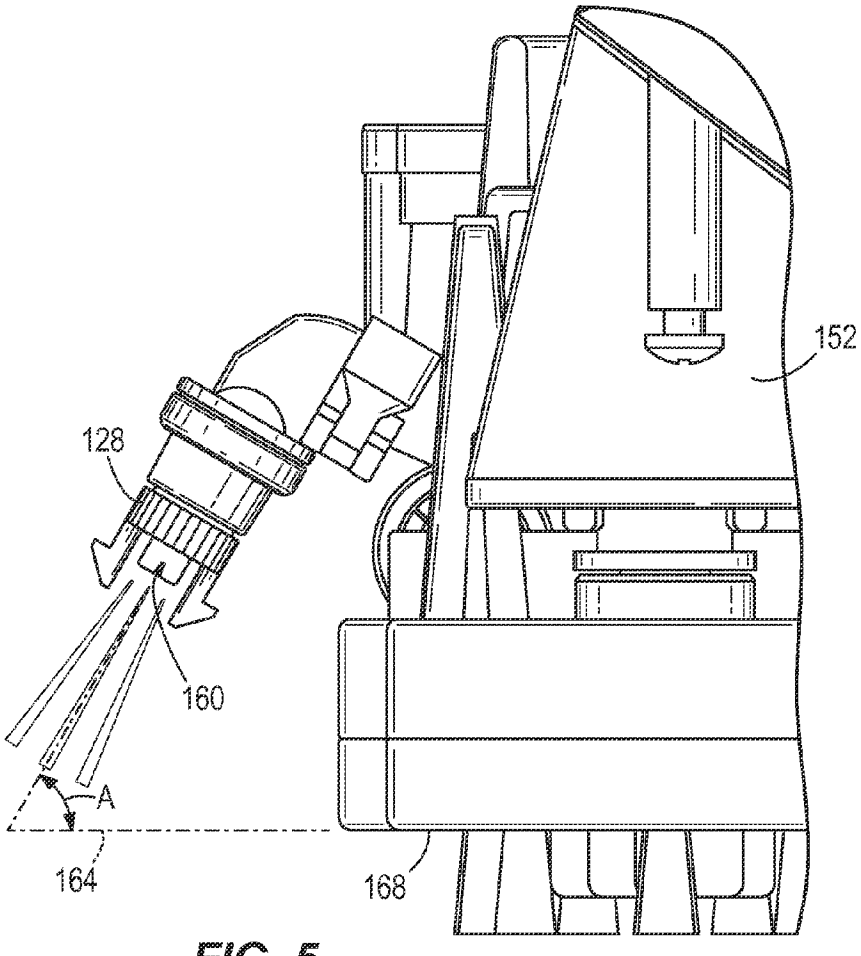
FIG. 5 is a side view of a portion of the floor cleaning machine shown in FIG. 4, the floor cleaning machine including a distribution nozzle in a first position.

In one embodiment, the extractor 120 switches between the wash mode and the sanitize mode by changing the angle at which cleaning solution is delivered to the surface. As shown in FIGS. 5 and 6, the distribution nozzle 128 is coupled to and supported by the foot 152 of the extractor 120. In the illustrated embodiment, the distribution nozzle 128 includes a single nozzle having a single outlet 160. In other embodiments, the distribution nozzle 128 may include multiple nozzles or may include a bar having multiple outlets to deliver cleaning solution onto the surface.

The illustrated distribution nozzle 128 is movable relative to the foot 152 between a first position (FIG. 5) for the wash mode and a second position (FIG. 6) for the sanitize mode. When in the first position, the outlet 160 of the distribution nozzle 128 is oriented at an acute angle A relative to a plane 164 defined by a lower surface 168 of the foot 152 (i.e., the surface 168 of the foot 152 that is generally parallel to and facing the surface being cleaned). In this position, the distribution nozzle 128 delivers cleaning solution onto the surface at the acute angle A. When in the second position, the outlet 160 of the distribution nozzle 128 is oriented generally perpendicular to the plane 164 defined by the lower surface 168 of the foot 152. In this position, the cleaning solution penetrates deeper into the surface (e.g., carpeting) such that the suction nozzle 140 recovers less cleaning solution from the surface than when in the first position. In other embodiments, the suction nozzle 140 may be oriented at a smaller acute, but non-perpendicular angle when in the second position. In the illustrated embodiment, the acute angle A is between about 30 degrees and about 60 degrees. As such, the outlet 160 of the distribution nozzle 128 is oriented between about 30 degrees and about 60 degrees further away from the surface being cleaned when the extractor 120 is in the wash mode than when the extractor 120 is in the sanitize mode.

In some embodiments, an actuator may be supported on the foot 152 to facilitate moving the distribution nozzle 128 between the first position and the second position. In such embodiments, the actuator may include, for example, a dial or button that is manually actuatable to move the nozzle 128. Actuating the actuator may move the nozzle 128 between two discrete positions (i.e., the first position and the second position), between a series of three or more discrete positions, or between an infinite number of positions between the first and second positions. In some embodiments, the distribution nozzle 128 may be electronically moved by actuation of a button on the extractor body 124.

In another embodiment, the extractor 120 may vary the pressure of cleaning solution being delivered by the distribution nozzle 128 onto the surface being cleaned to sanitize the surface. When in the wash mode, the distribution nozzle 128 delivers the cleaning solution at a first, relatively low pressure. When in the sanitize mode, the distribution nozzle 128 delivers the cleaning solution at a second, relatively high pressure. By delivering the cleaning solution at a higher pressure while in the sanitize mode, the solution will embed deeper into the surface being cleaned such that less solution is recovered by the suction nozzle 140. In some embodiments, the cleaning solution may be delivered at a pressure of about 15 pounds per square inch (psi) when in the sanitize mode.

In the illustrated embodiment, the pressure of the cleaning solution being delivered by the distribution nozzle 128 is varied by the distributor 132 (FIG. 1). The distributor 132 includes a pump 170 that draws the cleaning solution from the supply tank assembly 136 and propels the solution into the distribution nozzle 128. By varying an operating speed of the pump 170, the pressure of the cleaning solution may likewise be varied.

In other embodiments, the pressure of the cleaning solution may be varied by adjusting the shape and/or size of the outlet 160 of the distribution nozzle 128. For example, the outlet 160 may be opened a relatively larger amount to deliver cleaning solution at the first pressure and may be opened a relatively smaller amount to deliver cleaning solution at the second pressure. In some embodiments, the outlet 160 of the distribution nozzle 128 may be adjusted by, for example, manually rotating the nozzle 128. In other embodiments, the outlet 160 may be adjusted by mechanically or electrically actuating the nozzle 128.

Figure 7:
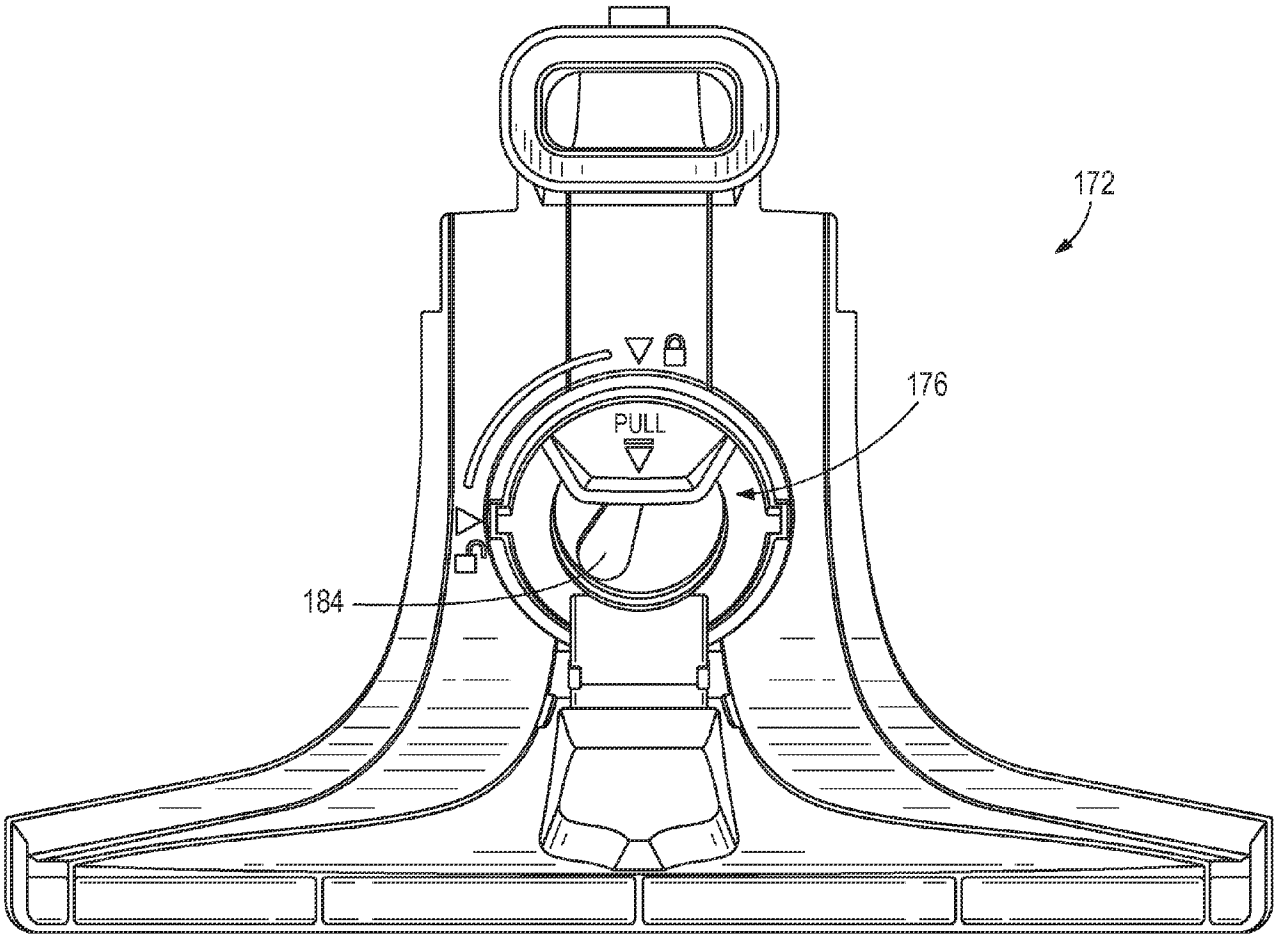
FIG. 7 is a top view of a suction nozzle for use with the floor cleaning machine shown in FIG. 4, the suction nozzle including a cover member in a first position to cover a bleed hole.
Figure 8:
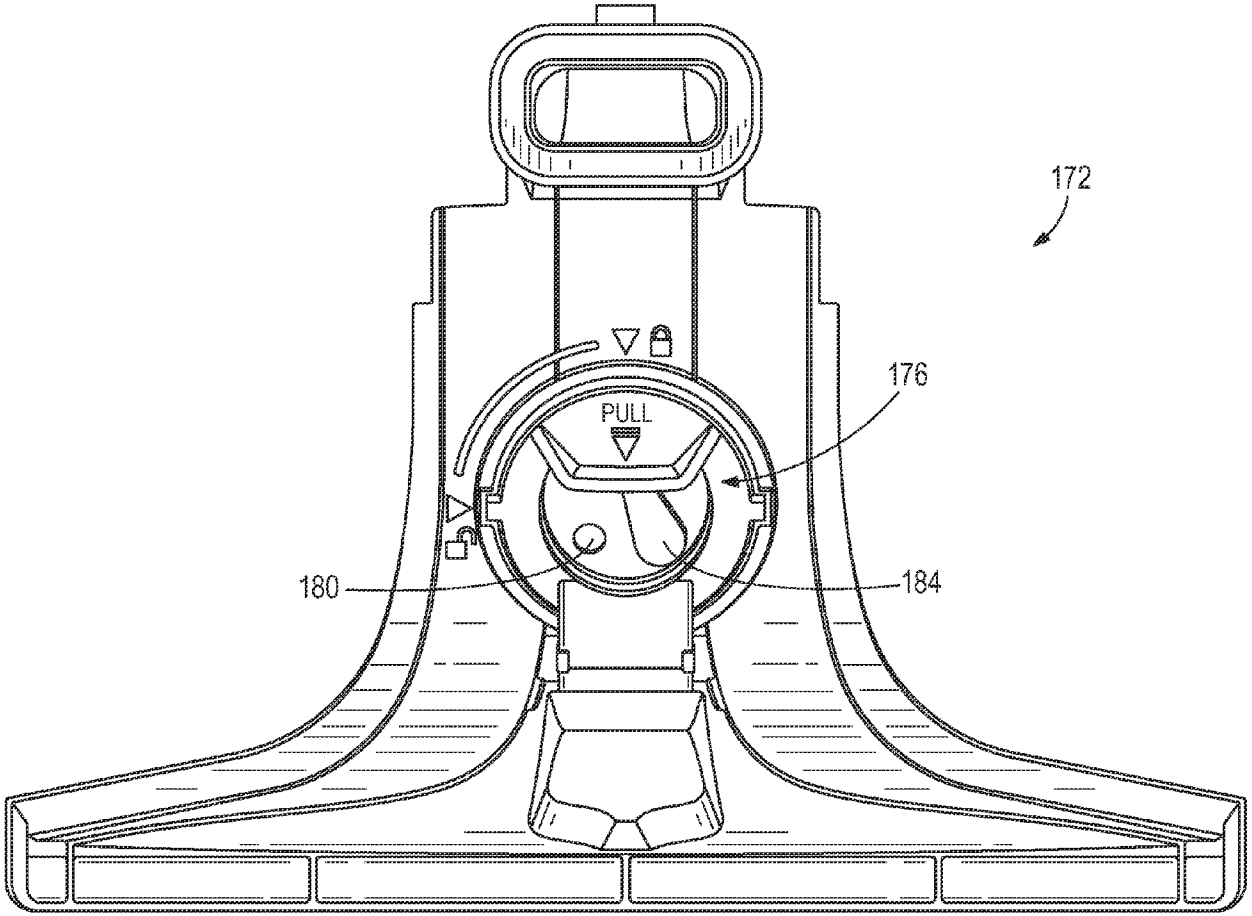
FIG. 8 is a top view of the suction nozzle of FIG. 7 with the cover member in a second position to open the bleed hole.

FIGS. 7 and 8 illustrate a suction, or recovery, nozzle 172 that is usable to reduce the recovery rate of the extractor 120 to sanitize the surface being cleaned. The illustrated suction nozzle 172 may be used with the extractor 120 instead of the suction nozzle 140 shown in FIG. 4. The suction nozzle 172 includes a recovery rate adjustment mechanism 176. The adjustment mechanism 176 is manually actuatable by a user to change the recovery rate, or suction efficiency, of the nozzle 172 and, thereby, the extractor 120. When in the wash mode, the adjustment mechanism 176 is configured such that the suction nozzle 172 has a relatively higher recovery rate. In this mode, the suction nozzle 172 leaves a first amount of cleaning solution on the surface being cleaned. When in the sanitize mode, the adjustment mechanism 176 is configured such that the suction nozzle 172 has a relatively lower recovery rate. In this mode, the suction nozzle 172 leaves a second, greater amount of cleaning solution on the surface being cleaned. By leaving more cleaning solution on the surface, the extractor 120 is capable of sanitizing the surface.

In the illustrated embodiment, the recovery rate adjustment mechanism 176 includes a bleed hole 180 (FIG. 8) and an actuator 184. The illustrated actuator 184 is a valve or cover member. The cover member 184 is movable (e.g., slidable and/or pivotable) relative to the bleed hole 180 to selectively open and close the bleed hole 180. When in the wash mode (FIG. 7), the bleed hole 180 is substantially covered by the cover member 184. When in the sanitize mode (FIG. 8), the bleed hole 180 is open (i.e., not covered by the cover member 184), creating a leak in the nozzle 172 to reduce the suction efficiency of the nozzle 172. In the illustrated embodiment, the cover member 184 is movable by manually pivoting the member 184. In other embodiments, the cover member 184 may be electrically pivoted. In some embodiments, the adjustment mechanism 176 may include multiple bleed holes. In such embodiments, all or some of the bleed holes may be selectively covered and uncovered to achieve the desired suction efficiency of the nozzle 172.

Referring back to FIG. 4, in another embodiment, the extractor 120 adjusts the amount of cleaning solution being delivered onto the surface being cleaned. In one construction, the extractor 120 delivers a greater volume of cleaning solution to the surface being cleaned when in the sanitize mode than when in the wash mode. In another construction, the extractor 120 delivers a greater concentration of cleaning solution to the surface being cleaned when in the sanitize mode than when in the wash mode. By delivering a greater volume and/or concentration of cleaning solution (particularly sanitizer) to the surface, more cleaning solution will be left on the surface for a given or constant recovery rate.

The illustrated extractor 120 includes an actuator 188 supported on the handle 156. In the illustrated embodiment, the actuator 188 is a mode selector having a dial 192. The dial 192 is rotatable to switch between the wash mode and the sanitize mode (and a rinse mode, if applicable). The dial 192 is also coupled to the distributor 132 to control operation of the distributor 132.

To increase the volume of cleaning solution being delivered to a surface while in the sanitize mode, the actuator 188 opens one or more valves in the distributor 132 a greater amount (compared to when in the wash mode) such that more sanitizer and water are drawn out of the supply tank assembly 136. The total volume of cleaning solution being delivered to the surface by the extractor 120 is thereby increased.

To increase the concentration of cleaning solution being delivered to the surface while in the sanitize mode, the actuator 188 opens a valve that is in communication with the first tank of the supply tank assembly 136 a greater amount (compared to when in the wash mode) such that more sanitizer is drawn out of the supply tank assembly 136. In some embodiments, the actuator 188 may also partially close a valve that is in communication with the second tank of the supply tank assembly 136 to decrease the amount of water being drawn out of the assembly 136. In such embodiments, the total volume of cleaning solution being delivered onto the surface by the extractor 120 is held relatively constant between the wash and sanitize modes, but the ratio of sanitizer to water is thereby increased. In some embodiments, the extractor 120 may deliver cleaning solution at a concentration of about 2.5% when in the wash mode and may deliver cleaning solution at a concentration of about 9% when in the sanitize mode. As such, the concentration of cleaning solution being delivered onto the surface when in the sanitize mode is between about three and four times higher than when in the wash mode.

In another embodiment, the recovery rate of the extractor 120 may be adjusted by varying a motor speed of the suction source 144. As noted above, the suction source 144 includes a motor 196 that drives a fan to create a vacuum, and thereby suction, through the suction nozzle 140. In the wash mode, the motor 196 is driven at a first, relatively high speed. In the sanitize mode, the motor 196 is driven at a second, relatively low speed. Suction through the suction nozzle 140 is therefore greater when in the wash mode than when in the sanitize mode. As such, more cleaning solution is left on the surface being cleaned when in the sanitize mode than when in the wash mode. In some embodiments, the actuator 188 on the handle 156 may be electrically coupled to the suction source 144 to vary the motor speed.

Figure 9:
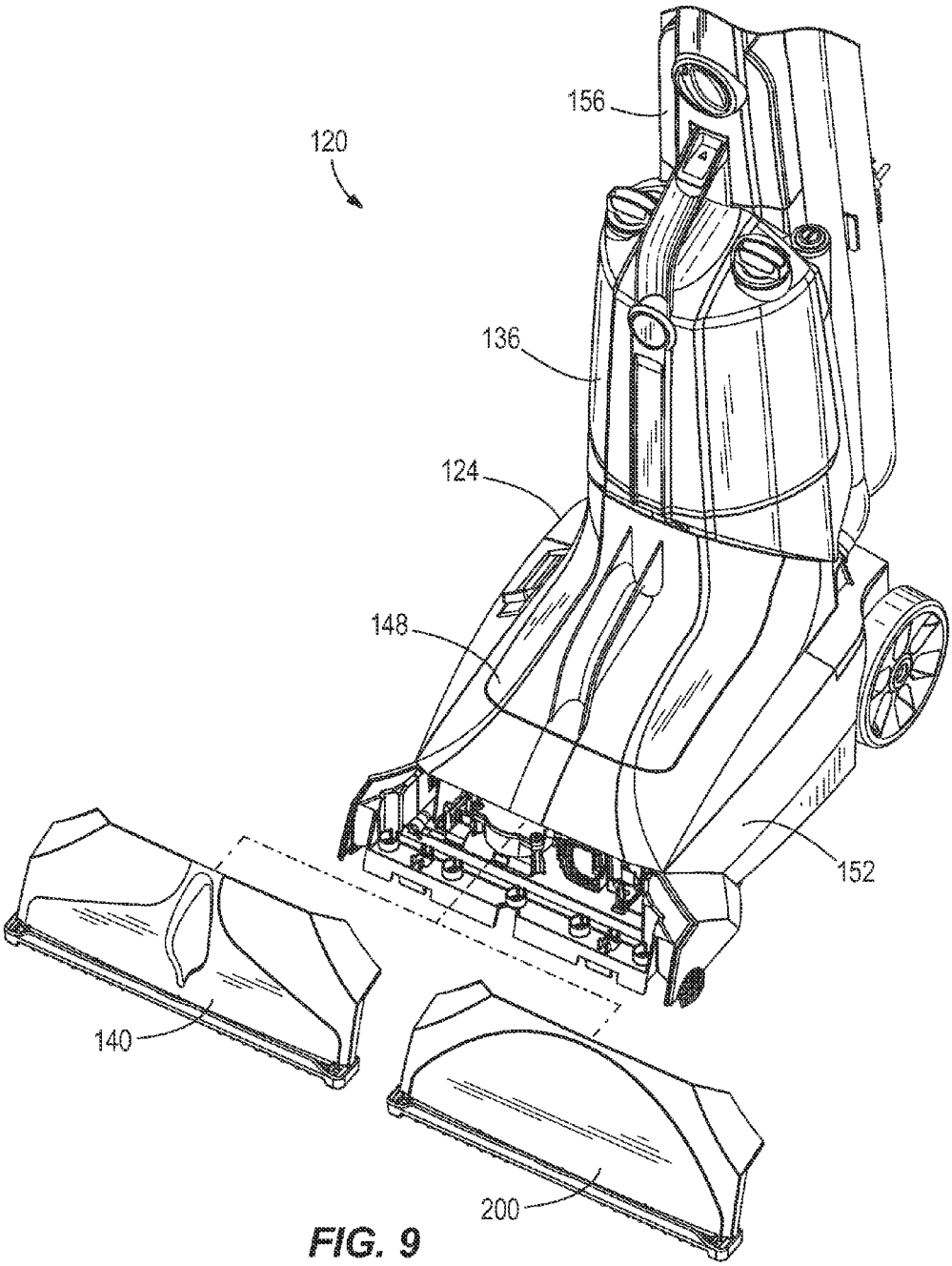
FIG. 9 is a perspective view of the floor cleaning machine of FIG. 4 configured to alternately receive a first suction nozzle and a second suction nozzle.

In another embodiment, the recovery rate of the extractor 120 may be adjusted by changing the suction nozzle 140. FIG. 9 illustrates the extractor 120 with two removable suction nozzles 140, 200. The first suction nozzle 140 is connected to the foot 152 of the extractor 120 in fluid communication with the suction source 144 and the recovery tank 148 when the extractor 120 is in the wash mode. The second suction nozzle 200 is connected to the foot 152 of the extractor 120 in fluid communication with the suction source 144 and the recovery tank 148 when the extractor 120 is in the sanitize mode. The suction nozzles 140, 200 can be alternately attached to and removed from the foot 152 with or without the use of tools. For example, in some embodiments, the suction nozzles 140, 200 may be secured to the foot 152 using a latch mechanism or snap fits. In other embodiments, the suction nozzles 140, 200 may be secured to the foot 152 using fasteners, such as screws. In some embodiments, both suction nozzles 140, 200 may be connected to and supported by the foot 152 simultaneously, but the extractor 120 may switch or toggle between the nozzles 140, 200 depending on whether the extractor 120 is in the wash mode or in the sanitize mode.

The suction nozzles 140, 200 are designed to have different recovery rates. The recovery rates of the nozzles 140, 200 may be determined by the cross-sectional areas and shapes of flowpaths extending through the nozzles 140, 200. The first suction nozzle 140 is designed to have a relatively high recovery rate such that less cleaning solution is left on the surface being cleaned. The second suction nozzle 200 is designed to have a relatively low recovery rate such that more cleaning solution is left on the surface being cleaned. In some embodiments, the first suction nozzle 140 may have a recovery rate that is about 5% to 7% higher than the recovery rate of the second suction nozzle 200. By leaving more cleaning solution on the surface when using the second nozzle 200, the extractor 120 is capable of sanitizing the surface. In some embodiments, no suction nozzle may be attached to the foot 152 when the extractor 120 is in the sanitize mode such that all of the cleaning fluid is unrecovered (i.e., left on the surface) during operation in the sanitize mode.

Figure 11:
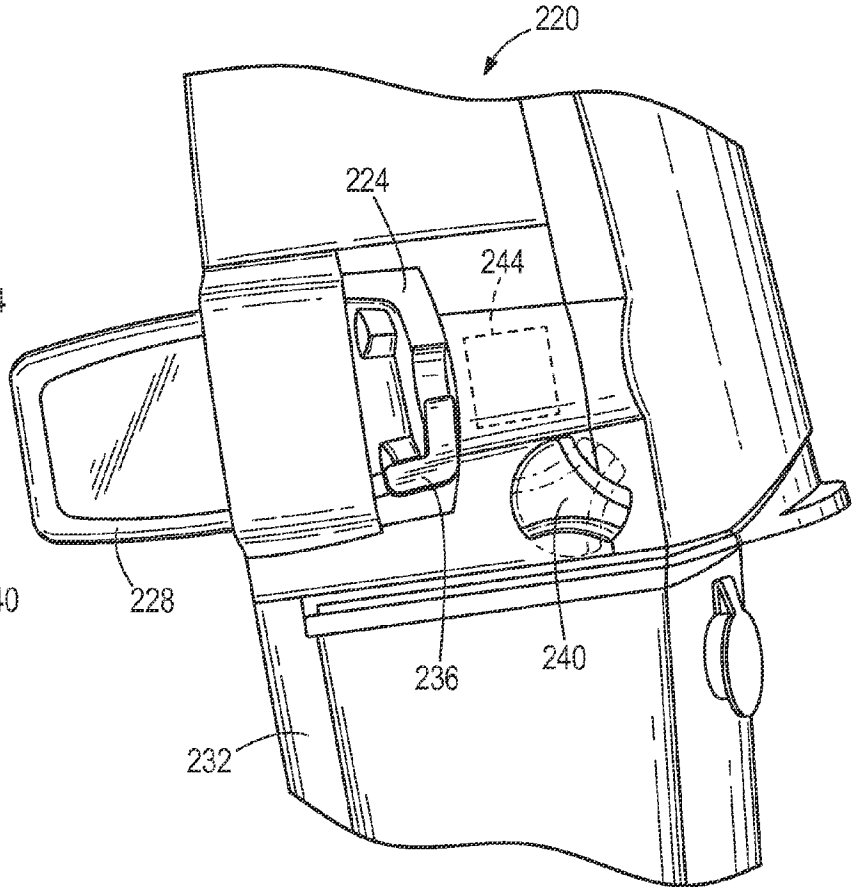
FIG. 11 is a side view of the portion of the floor cleaning machine shown in FIG. 10.
Figure 10:
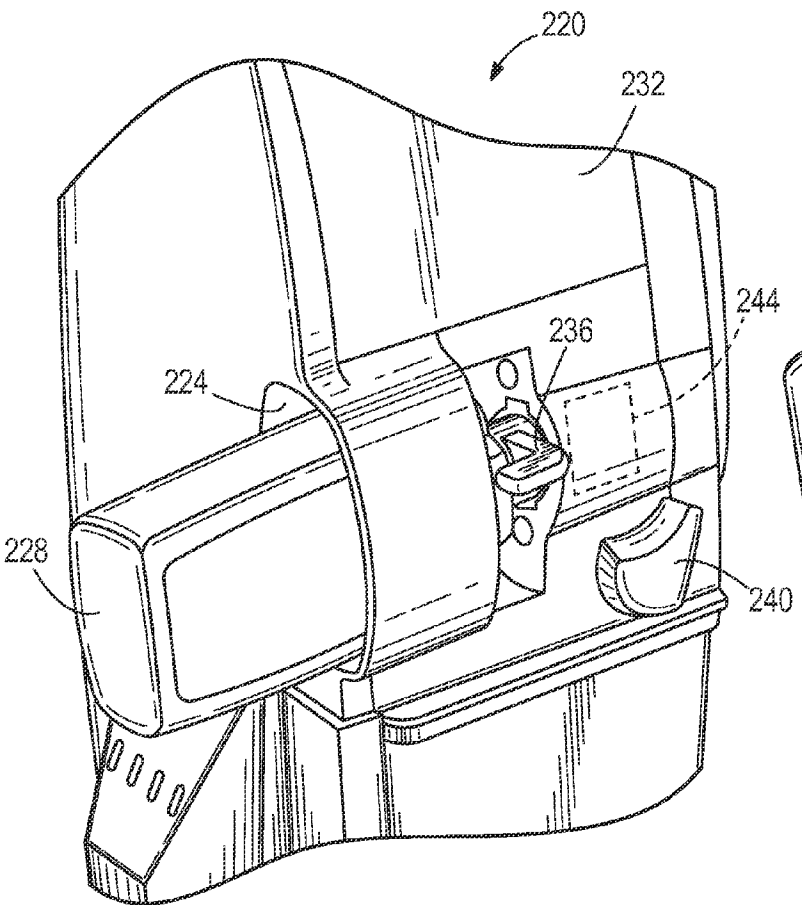
FIG. 10 is a side perspective view of a portion of another floor cleaning machine, the floor cleaning machine including a port for receiving a bottle of cleaning solution.

FIGS. 10 and 11 illustrate a portion of another extractor 220. Although not shown, the extractor 220 generally includes the same components as the extractors 20, 120 described above.

The illustrated extractor 220 includes a port 224 configured to alternately receive bottles 228 of cleaning solution. For example, the port 224 may alternately receive a first bottle of detergent and a second bottle of sanitizer. Inserting the bottles 228 into the port fluidly connects the bottles 228 to a distributor and a distribution nozzle of the extractor 220. When the port 224 receives the first bottle, the extractor 220 is in a wash mode. When the port 224 receives the second bottle, the extractor 220 is in a sanitize mode. The bottles 228 may be off-the-shelf bottles that are shaped and sized to fit directly into the port 224. The extractor 220 mixes the detergent or sanitizer from the bottles 228 with water from a supply tank assembly to create a cleaning solution.

In the illustrated embodiment, the port 224 is formed in a body 232 of the extractor 220 and includes a pivotable latch 236. The latch 236 moves relative to the body 232 between an unlocked position (FIG. 10) and a locked position (FIG. 11) to releasably secure the bottles 228 within the port 224. When in the unlocked position, the port 224 can receive and allows removal of one of the bottles 228. When in the locked position, the latch 236 inhibits the attached bottle 228 from being removed from the port 224.

The extractor 220 also includes an actuator 240 supported on the body 232 adjacent the port 224. The illustrated actuator 240 includes a rotatable knob. The actuator 240 is coupled to a valve 244 to selectively fluidly connect the bottles 228 to the distributor. When the actuator is in a first position (FIG. 10), the valve 244 is closed such that cleaning solution is not drawn out of the attached bottle 228 by the distributor during operation of the extractor 220. When the actuator 240 is in a second position (shown in solid lines in FIG. 10), the valve 244 is opened such that the distributor draws cleaning fluid out of the attached bottle 228 during operation of the extractor 220.

Figure 12:
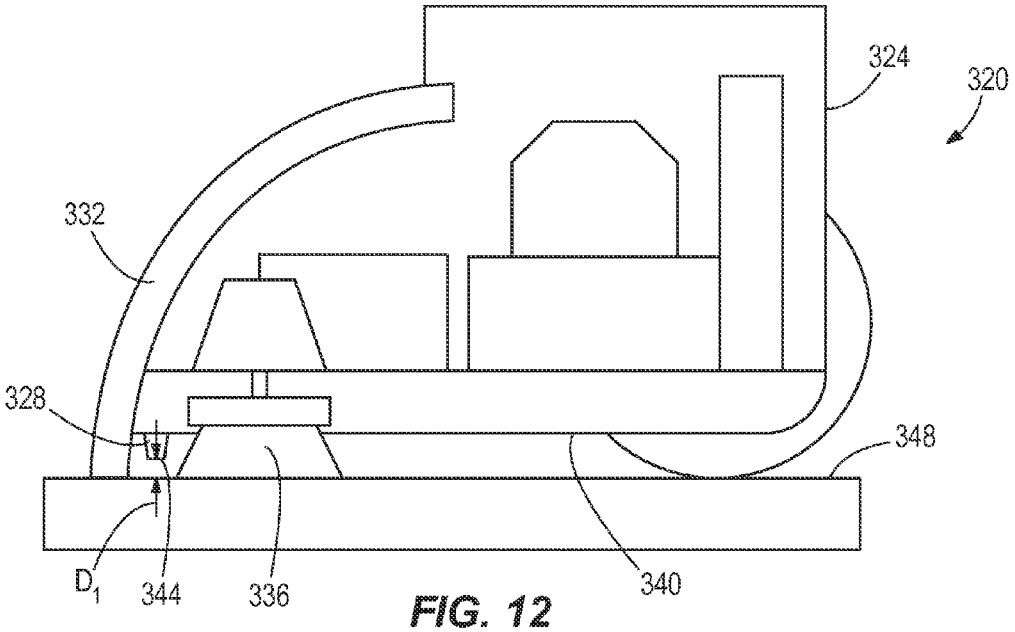
FIG. 12 is a schematic of a portion of a floor cleaning machine, the floor cleaning machine including a distribution nozzle in a first position.
Figure 13:
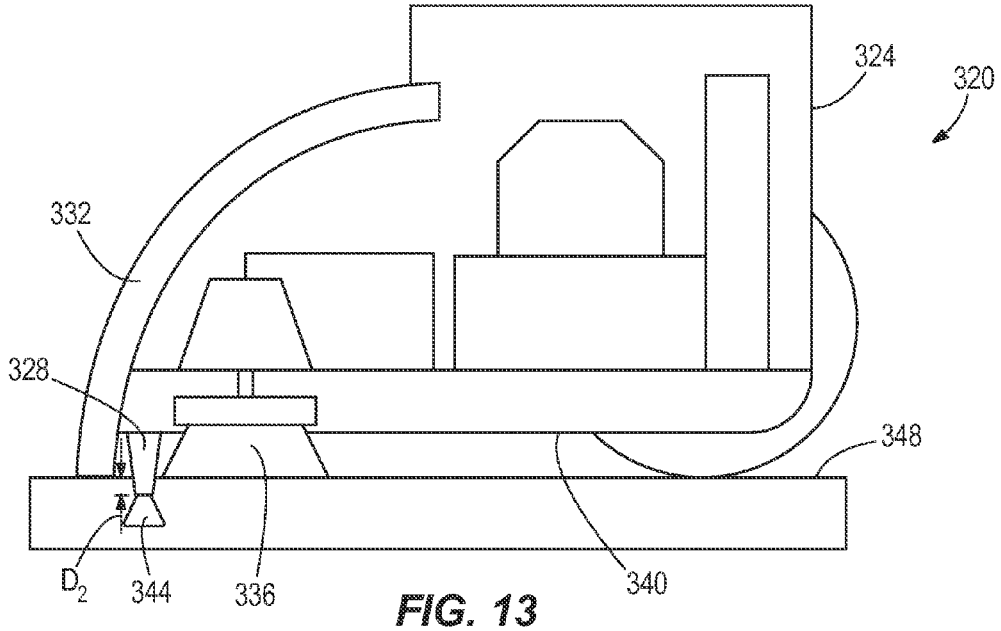
FIG. 13 is a schematic of the portion of the floor cleaning machine of FIG. 12 with the distribution nozzle in a second position.

FIGS. 12 and 13 illustrate a portion of another extractor 320. Although not shown, the extractor 320 generally includes the same components as the extractors 20, 120 described above.

The illustrated extractor 320 includes a base 324 that supports a distribution nozzle 328, a suction nozzle 332, and a brush assembly 336. The distribution nozzle 328 extends from a lower surface 340 of the base 324 and defines an outlet 344. The outlet 344 directs cleaning fluid onto a surface 348 to be cleaned. As shown in FIG. 12, the outlet 344 of the distribution nozzle 328 is spaced a first vertical distance $D_1$ from the surface 348 when the extractor 320 is in a wash mode. As shown in FIG. 13, the outlet 344 of the distribution nozzle 328 is spaced a second vertical distance $D_2$ from the surface 348 when the extractor 320 is in a sanitize mode. The second vertical distance $D_2$ is less than the first vertical distance $D_1$ so that the outlet 344 is closer to the surface 348 when the extractor 320 is in the sanitize mode than when the extractor 320 is in the wash mode. In other words, the distribution nozzle 328 extends a further distance from the lower surface 340 of the base 324 when the extractor 320 is in the sanitize mode than when the extractor 320 is in the wash mode. Such an arrangement helps the cleaning solution being delivered by the distribution nozzle 328 to penetrate the surface 348 a greater amount when in the sanitize mode than when in the wash mode.

In the illustrated embodiment, the distribution nozzle 328 itself penetrates into the surface 348 when the extractor 320 is in the sanitize mode. The surface 348 may be, for example, carpet that allows the distribution nozzle 328 to extend into the surface 348 between carpet fibers. In this position, the vertical distance $D_2$ between the outlet 344 of the distribution nozzle 328 and the surface 348 is less than zero. By penetrating the surface 348, the distribution nozzle 328 ensures that cleaning fluid is delivered deep into the surface 348 to sanitize the surface. In other embodiments, the distribution nozzle 328 may be positioned closer to the surface 348 when the extractor 320 is in the sanitize mode than when the extractor 320 is in the wash mode, yet still be spaced above the surface 348. In further embodiments, the second vertical distance $D_2$ between the distribution nozzle 328 and the surface 348 may be zero when the extractor 320 is in the sanitize mode.

The distribution nozzle 328 may be manually or automatically moved between the first position (FIG. 12) and the second position (FIG. 13) when the extractor 320 switches between the wash and sanitize modes. In some embodiments, an actuator, such as a lever or dial, may be mechanically linked to the distribution nozzle 328 to move the nozzle 328 vertically relative to the lower surface 340 of the base 324. In other embodiments, the distribution nozzle 328 may be electrically driven by a motor (or other suitable component of the extractor 320) to move between the first and second positions.

Figure 14:
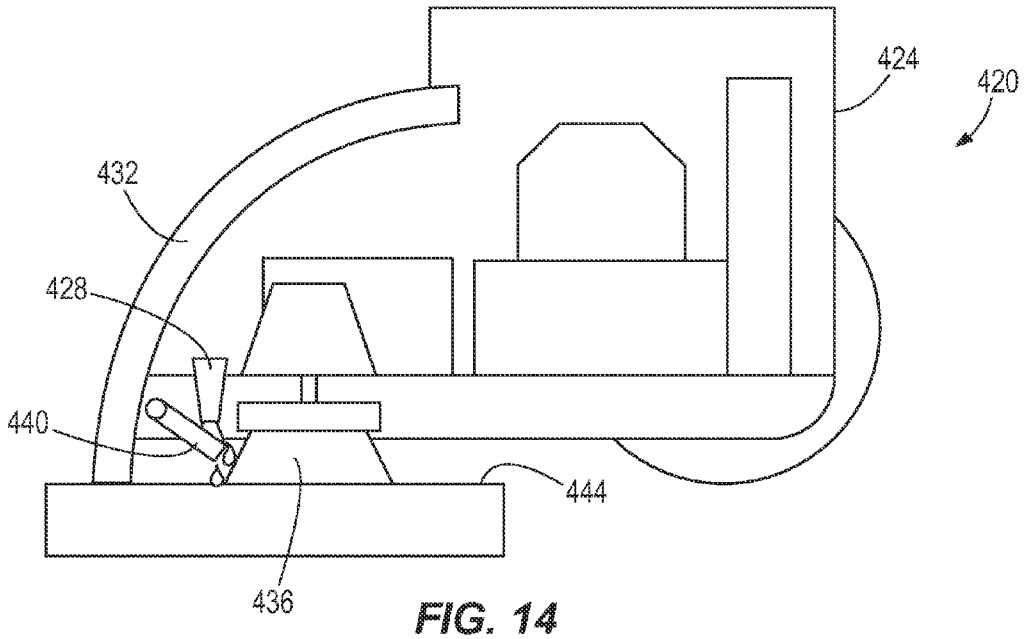
FIG. 14 is a schematic of a portion of another floor cleaning machine, the floor cleaning machine including a deflector in a first position.
Figure 15:
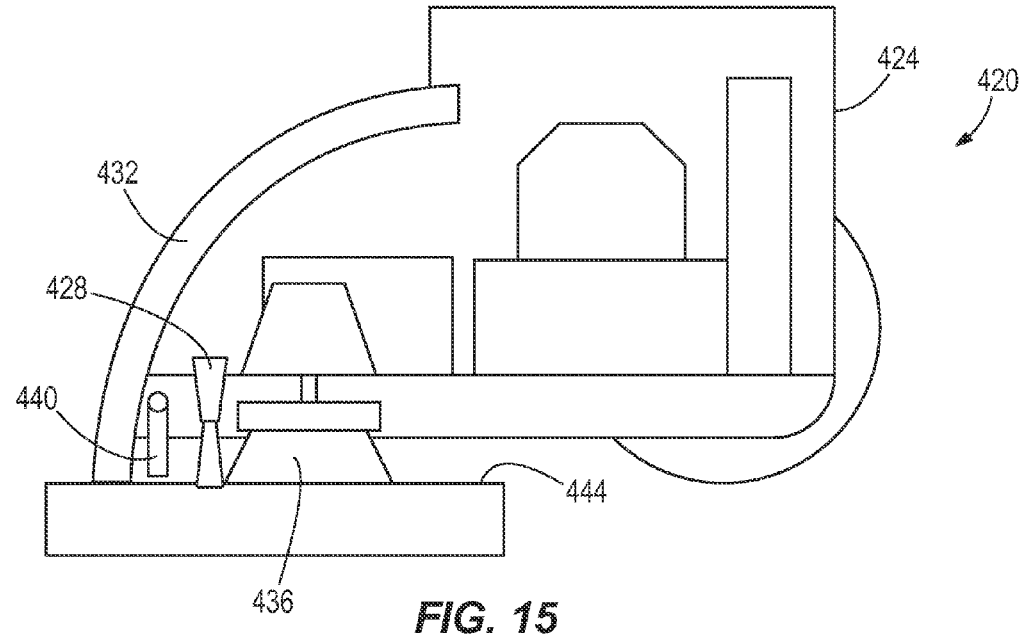
FIG. 15 is a schematic of the portion of the floor cleaning machine of FIG. 14 with the deflector in a second position.

FIGS. 14 and 15 illustrate a portion of another extractor 420. Although not shown, the extractor 420 generally includes the same components as the extractors 20, 120 described above.

The illustrated extractor 420 includes a base 424 that supports a distribution nozzle 428, a suction nozzle 432, and a brush assembly 436. The extractor 420 also includes a deflector 440 coupled to the base 424 adjacent the distribution nozzle 428. The deflector 440 is movable relative to the base 424 and the distribution nozzle 428 between a first position (FIG. 14) and a second position (FIG. 15). In the illustrated embodiment, the deflector 440 is pivotally coupled to the base 424 such that the deflector 440 pivots between the first and second positions. In other embodiments, the deflector 440 may slide linearly relative to the base 424 between the first and second positions.

The deflector 440 includes a plate that is configured to selectively interfere with and deflect cleaning solution being delivered by the distribution nozzle 428. When the extractor 420 is in a wash mode (as shown in FIG. 14), the deflector 440 is positioned between the distribution nozzle 428 and a surface 444 to be cleaned such that cleaning solution exiting the nozzle 428 contacts the deflector 440 before reaching the surface 444. The deflector 440 thereby interferes with delivery of the cleaning solution to reduce penetration of the solution into the surface 444. When the extractor 420 is in a sanitize mode (as shown in FIG. 15), the deflector 440 is moved away from between the distribution nozzle 428 and the surface 444 such that cleaning solution exiting the nozzle 428 does not contact the deflector 440. In this position, the deflector 440 does not interfere with delivery of the cleaning solution, allowing the cleaning solution to penetrate deeper into the surface 444.

The deflector 440 may be manually or automatically moved between the first position (FIG. 14) and the second position (FIG. 15) when the extractor 420 switches between the wash and sanitize modes. In some embodiments, an actuator, such as a lever or dial, may be mechanically linked to the deflector 440 to pivot the deflector 440 relative to the base 424. In other embodiments, the deflector 440 may be electrically pivoted by a motor (or other suitable component of the extractor 420) to pivot between the first and second positions.

Figure 16:
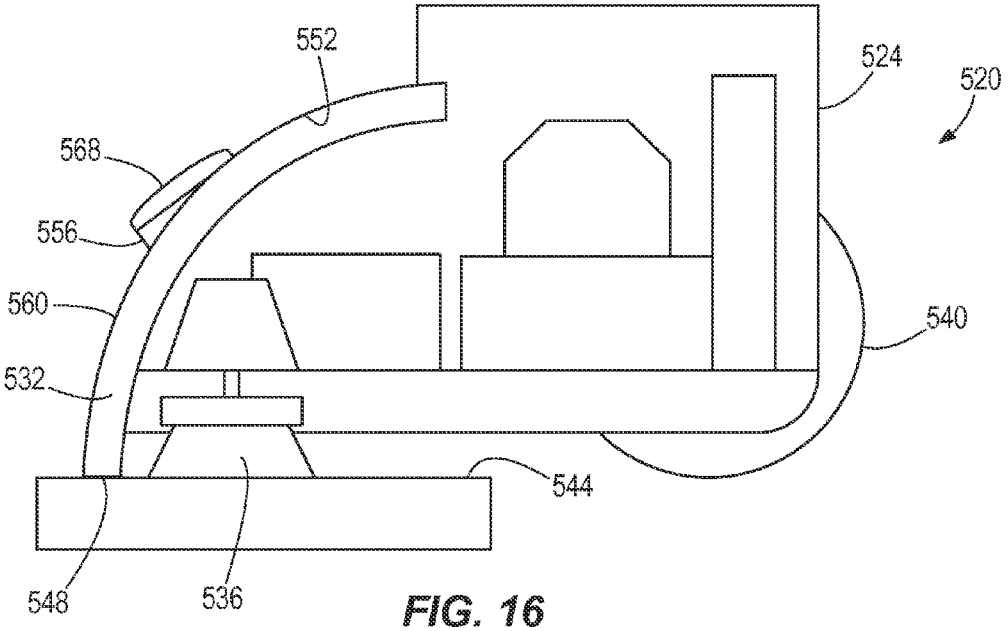
FIG. 16 is a schematic of a portion of another floor cleaning machine, the floor cleaning machine including a suction nozzle with a port.
Figure 17:
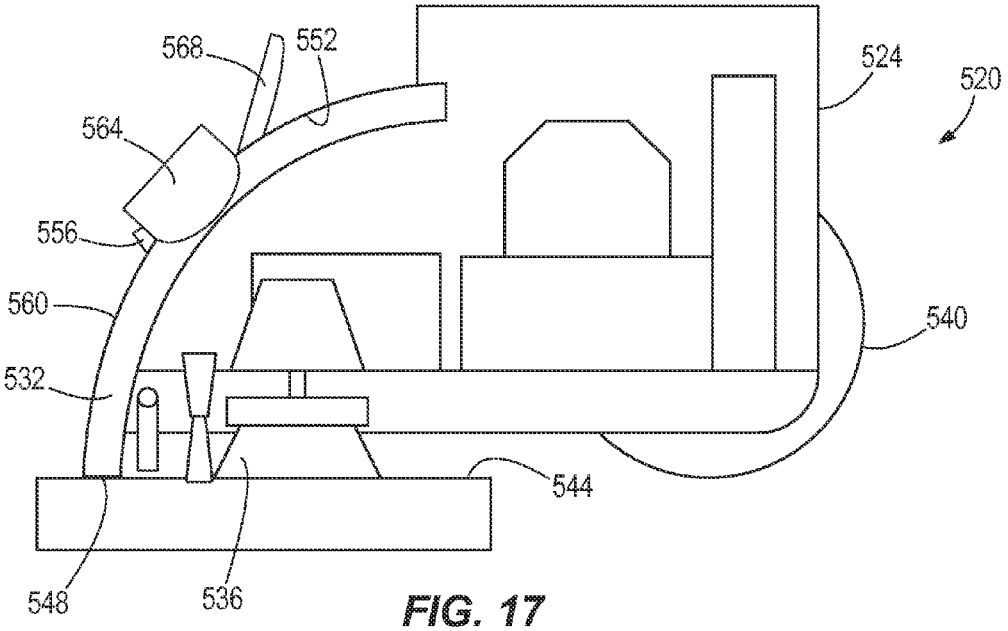
FIG. 17 is a schematic of the portion of the floor cleaning machine of FIG. 16 with a blocking member positioned in the port of the suction nozzle.

FIGS. 16 and 17 illustrate a portion of another extractor 520. Although not shown, the extractor 520 generally includes the same components as the extractors 20, 120 described above.

The illustrated extractor 520 includes a base 524 that supports a suction nozzle 532 and a brush assembly 536. The suction nozzle 532 is located on a front of the base 524, opposite from rear wheels 540, to draw fluid and dirt from a surface 544 into a recovery tank (not shown). The suction nozzle 532 defines an opening 548 adjacent the surface 544 and a flowpath 552 extending from the opening 548 to the recovery tank. In the illustrated embodiment, the suction nozzle 532 also includes a port 556 formed in a front face 560 of the suction nozzle 532. The port 556 is configured to selectively receive a blocking member 564 (FIG. 17) to change a recovery rate of the suction nozzle 532. A cover 568 is pivotally coupled to the suction nozzle 532 to cover the port 556 when the blocking member 564 is not positioned in the port 556.

As shown in FIG. 16, when the extractor 520 is in a wash mode, the blocking member 564 (FIG. 17) is not coupled to the suction nozzle 532 and the cover 568 is closed. In this condition, the opening 548 and the flowpath 552 of the suction nozzle 532 are substantially unblocked or unobstructed. As shown in FIG. 17, when the extractor 520 is in a sanitize mode, the cover 568 is pivoted open and the blocking member 564 is inserted into the port 556. In this condition, the blocking member 564 extends into the flowpath 556 to block at least a portion of the flowpath 556. By obstructing the flowpath 556, the blocking member 564 reduces the recovery rate of the suction nozzle 532. As such, during operation, more cleaning solution will be left on the surface 544 and not recovered by the extractor 520, thereby helping to sanitize the surface 544.

In some embodiments, the blocking member 564 may extend into the suction nozzle 532 to completely block the flowpath 552. In such embodiments, the blocking member 564 essentially inhibits any recovery of cleaning solution from the surface 544 by preventing fluid and dirt from flowing through the suction nozzle 532. In other embodiments, the blocking member 564 may be inserted into the opening 548 of the suction nozzle 532 when the extractor 520 is in the sanitize mode to partially or completely block the opening 548. In still other embodiments, multiple blocking members 564 may be coupled to the suction nozzle 532 to block the flowpath 552 and/or the opening 548 and reduce the recovery rate of the nozzle 532 a desired amount when the extractor 520 is in the sanitize mode.

Figure 19:
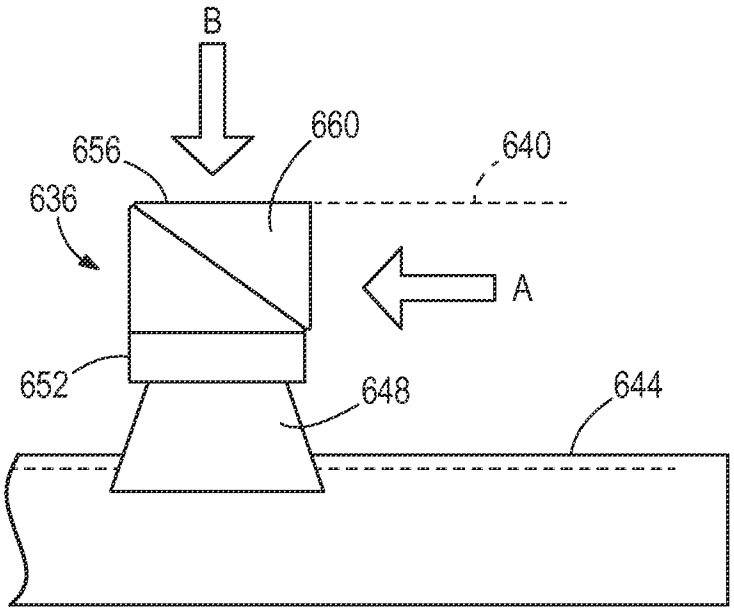
FIG. 19 illustrates the brush assembly and the cam member in a second position.
Figure 18:
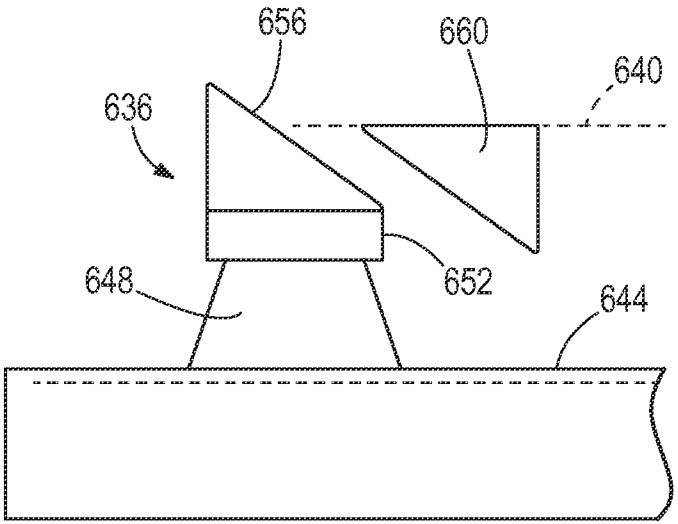
FIG. 18 illustrates a brush assembly and a cam member fir use with a floor cleaning machine, the brush assembly and the cam member being in a first position.

FIGS. 18 and 19 illustrate a brush assembly 636 for use with an extractor (not shown). The extractor may be configured similar to the extractors 320, 420, 520 discussed above and may include generally the same components as the extractors 20, 120 described above. Similarly, the brush assembly 636 may be one of the brush assemblies 336, 436, 536 shown in FIGS. 12-17.

The brush assembly 636 is configured to be supported on a base of the extractor adjacent a distribution nozzle. The brush assembly 636 extends from a lower surface 640 of the base to engage a surface 644 to be cleaned. The brush assembly 636 is operable to agitate or scrub the surface 644 to help cleaning solution penetrate the surface 644. In some embodiments, the brush assembly 636 includes a series of spin scrub brushes 648 that are electrically or pneumatically actuated (e.g., rotated) to scrub the surface 644. In other embodiments, the brush assembly 636 may include a single brush that is rotated to agitate the surface 644. The illustrated brush assembly 636 includes the brushes 648, a support member 652, and a cam surface 656. The brushes 648 are rotatably mounted to a first side of the support member 652. The cam surface 656 is formed on a second side of the support member 652 opposite from the brushes 648.

The extractor also includes a cam member 660 that selectively engages the cam surface 656 to move the brush assembly 636 relative to the base. The illustrated cam member 660 is a wedge, although other suitable cam members may also or alternatively be employed. The cam member 660 is slidable along the lower surface 640 of the base between a first position (FIG. 18), in which the cam member 660 is spaced apart from and disengages the brush assembly 636, and a second position (FIG. 19), in which the cam member 660 engages the brush assembly 636. As shown in FIG. 19, the cam member 660 slides in a generally horizontal direction A (e.g., in a direction parallel to the lower surface 640) to engage the cam surface 656 of the brush assembly 636. As the cam member 660 engages the brush assembly 636, the cam member 660 pushes the brush assembly 636 in a generally vertical direction B (e.g., in a direction perpendicular to the lower surface 640) toward the surface 644 to be cleaned.

When the brush assembly 636 and the cam member 660 are in the first position (FIG. 18), the extractor is in a wash mode. In this position, the brush assembly 636 floats freely on the base and engages the surface 644 with a first force. When the brush assembly 636 and the cam member 660 are in the second position (FIG. 19), the extractor is in a sanitize mode. In this position, the brush assembly 636 is wedged downward by the cam member 660 such that the brush assembly 636 engages the surface 644 with a second force that is greater than the first force. By engaging the surface 644 with a greater force, the brush assembly 636 is able to scrub the surface 644 harder, thereby helping the cleaning solution penetrate deeper into the surface 644.

The cam member 660 may be manually or automatically moved between the first position and the second position when the extractor switches between the wash and sanitize modes. In some embodiments, an actuator, such as a lever or dial, may be mechanically linked to the cam member 660 to slide the cam member 660 along the lower surface 640 of the base. In other embodiments, the cam member 660 may be electrically moved by a motor (or other suitable component of the extractor) to slide between the first and second positions.

In other embodiments, the brush assembly 636 may be pressed into the surface 644 with greater force when the extractor is in the sanitize mode than when the extractor is in the wash mode by pivoting closer to the surface 644. Additionally or alternatively, a motor of the extractor may drive the brush assembly 636 harder (e.g., faster) when the extractor is in the sanitize mode than when the extractor is in the wash mode.

Figure 20:
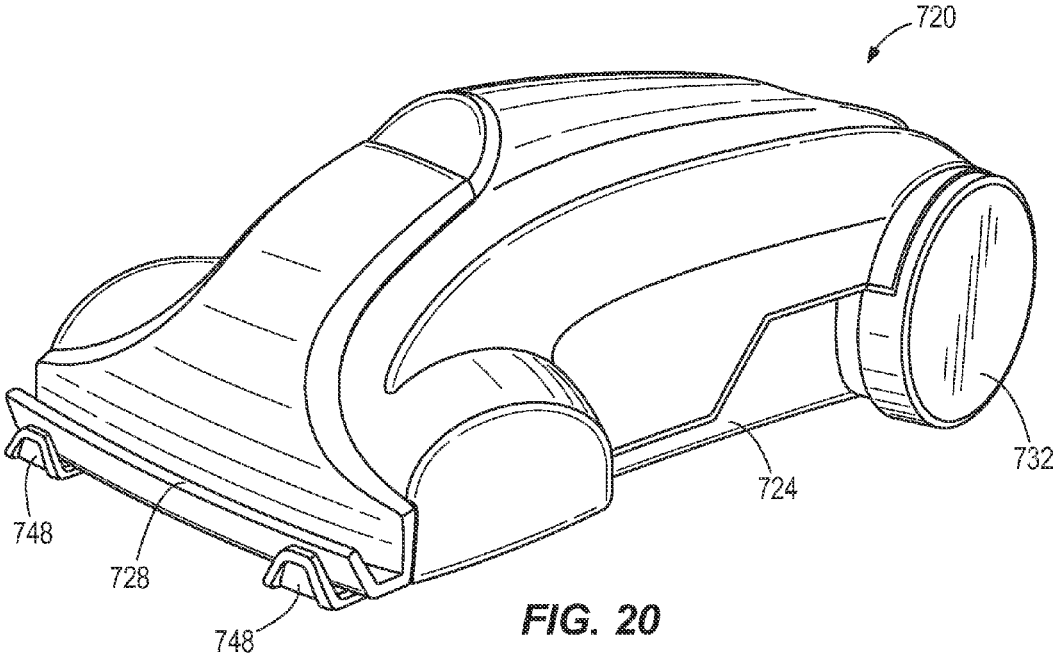
FIG. 20 is a perspective view of a portion of another floor cleaning machine.
Figure 21:
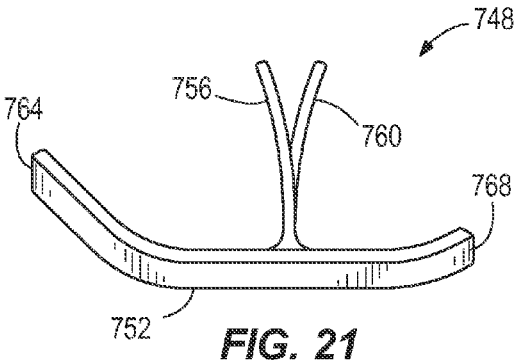
FIGS. 21-24 illustrate various views of a lift member for use with the floor cleaning machine of FIG. 20.
Figure 22:
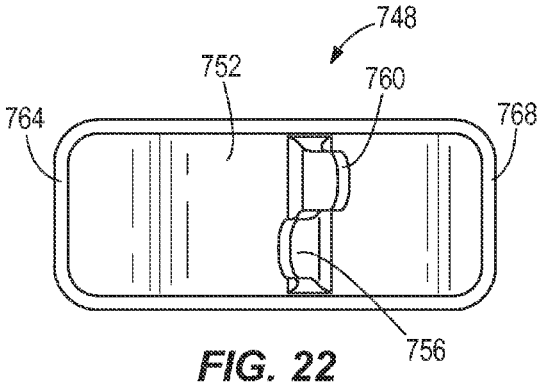
Figure 23:
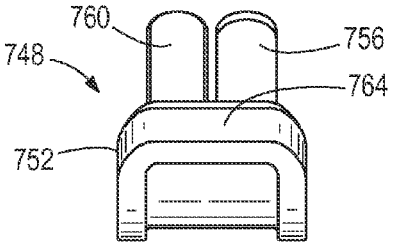
Figure 24:
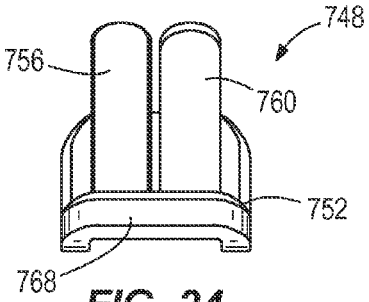

FIG. 20 illustrates a portion of another extractor 720. Although not shown, the extractor 720 generally includes the same components as the extractors 20, 120 described above.

Figure 25:
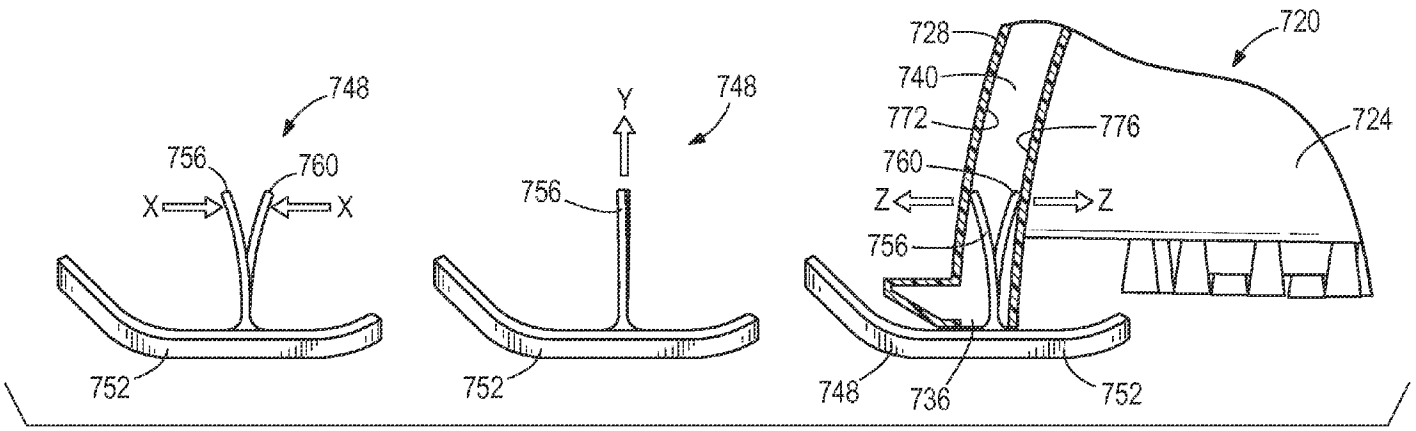
FIG. 25 illustrates a method of connecting the lift member of FIGS. 21-24 to the floor cleaning machine of FIG. 20.

The illustrated extractor 720 includes a base 724 and a suction nozzle 728 supported by the base 724. The suction nozzle 728 is located on a front of the base 724, opposite from rear wheels 732. The suction nozzle 728 defines an opening 736 and a flowpath 740 (FIG. 25). The opening 736 communicates with a surface 744 to be cleaned (FIG. 26) to draw fluid and dirt from the surface 744 into the suction nozzle 728. The flowpath 740 extends from the opening 736 to a recovery tank (not shown) to direct fluid and dirt drawn up through the opening 736 into the recovery tank.

The extractor 720 also includes two lift members 748 coupled to the suction nozzle 728. As shown in FIGS. 21-24, each lift member 748 includes a base portion 752 and two tabs 756, 760 extending generally perpendicularly from the base portion 752. The base portion 752, or ski, includes an upwardly-titled forward end 764 and an upwardly-titled rearward end 768. A larger section of the base portion 752 is upwardly-tilted at the forward end 764 than at the rearward end 768. The base portion 752 is configured to engage and ride along the surface 744 (FIG. 26) during operation of the extractor 720. The tabs 756, 760 are flexible such that each tab 756, 760 can bend or deflect to facilitate connecting the lift member 748 to the suction nozzle 728. When at rest, the tabs 756, 760 are bent in opposing directions. The first tab 756 is bent slightly toward the forward end 764 of the base portion 752, while the second tab 760 is bent slightly toward the rearward end 768 of the base portion 752.

FIG. 25 illustrates steps for connecting one of the lift members 748 to the suction nozzle 728. First, starting at the leftmost drawing, the two tabs 756, 760 are pushed toward each other (in the direction of arrows X) such that the tabs 756, 760 align and extend perpendicularly from the base portion 752. When the tabs 756, 760 are aligned, as shown in the middle drawing, the tabs 756, 760 are inserted (in the direction of arrow Y) into the opening 736 of the suction nozzle 728. Once inserted into the suction nozzle 728, as shown in the rightmost drawing, the tabs 756, 760 return to their at-rest, bent states (in the direction of arrows Z) and engage inner surfaces 772, 776 of the suction nozzle 728. The lift member 748 is thereby releasably secured within the suction nozzle 728 such that the lift member 748 will not fall out of the suction nozzle 728, but can be pulled out of the nozzle 728 to disconnect the lift member 748 from the nozzle 728.

Figure 26:
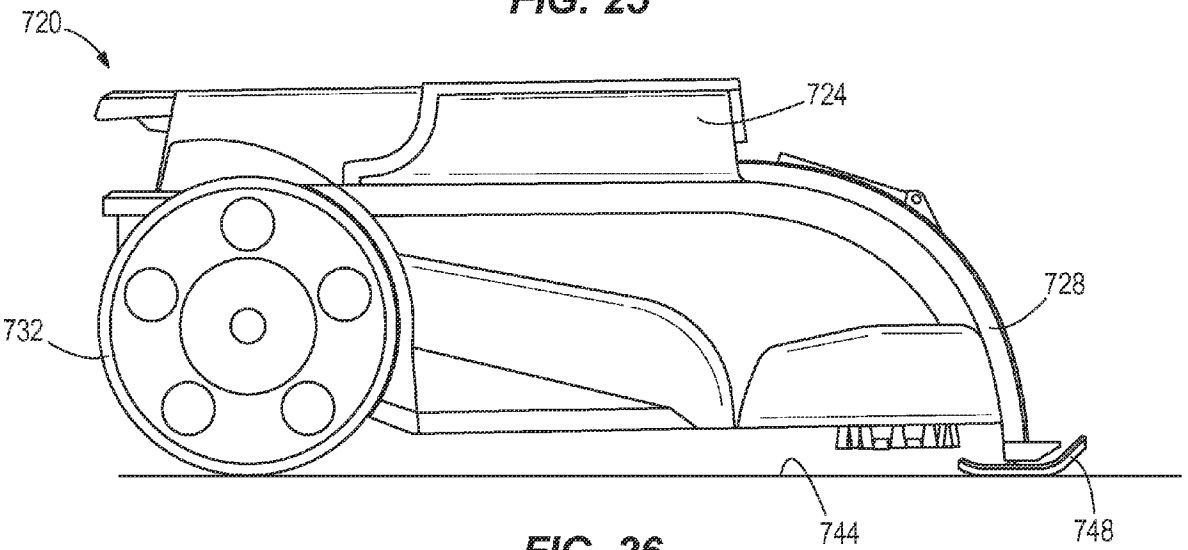
FIG. 26 is a side view of the portion of the floor cleaning machine of FIG. 20 with the lift member connected.

As shown in FIG. 26, when the lift members 748 are coupled to the suction nozzle 728, the lift members 748 lift or raise the suction nozzle 728 further away from the surface 744 to be cleaned than if the lift members 748 were not present. Raising the suction nozzle 728 of the extractor 720 away from the surface 744 lowers a recovery rate of the extractor 720 and, more particularly, of the nozzle 728. In addition, the lift members 748 block a portion of the opening 736 to further reduce the recovery rate of the suction nozzle 728 (similar to the blocking member 564 shown in FIG. 17). During operation of the extractor 720 with the lift members 748, more cleaning solution will be left on the surface 744 and not recovered by the extractor 720. As such, the lift members 748 are connected to and usable with the extractor 720 when the extractor 720 is in a sanitize mode. Conversely, the lift members 748 are removed from the suction nozzle 728 when the extractor 720 is in a wash mode. In other embodiments, fewer or more lift members 748 may be coupled to the suction nozzle 728 and/or the lift members 748 may be relatively taller or shorter to adjust the recovery rate of the suction nozzle 728 a desired amount.

Figure 27:
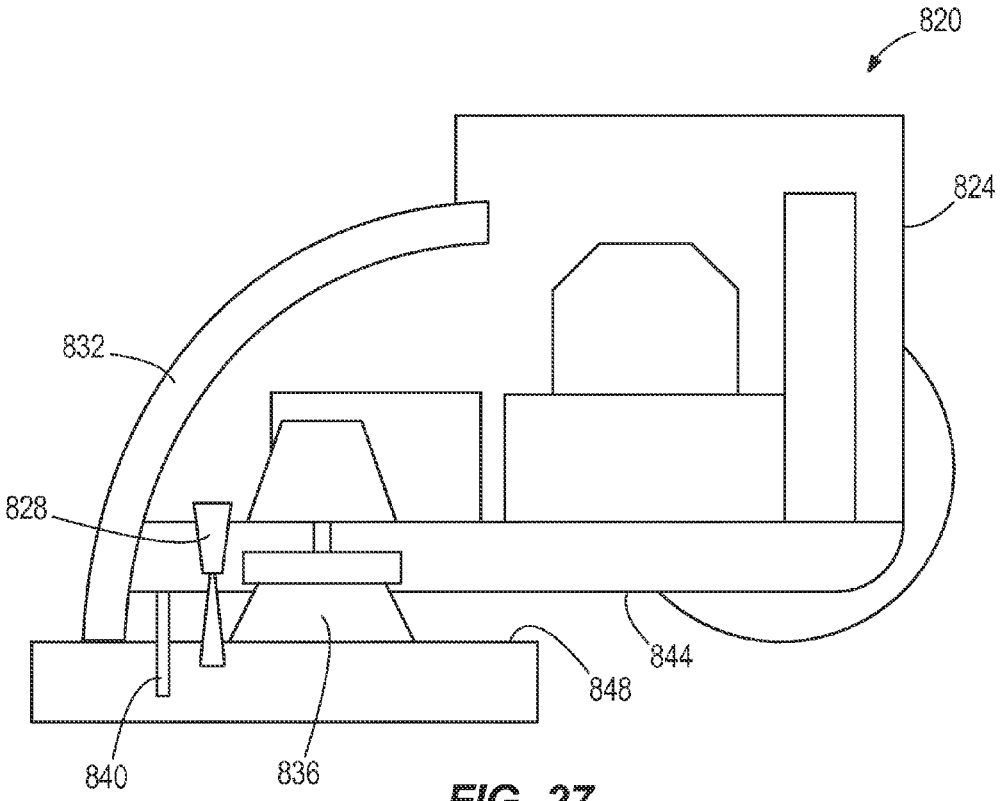
FIG. 27 is a schematic of a portion of another floor cleaning machine, the floor cleaning machine including a grooming member.

FIG. 27 illustrates a portion of another extractor 820. Although not shown, the extractor 820 generally includes the same components as the extractors 20, 120 described above.

Figure 28:
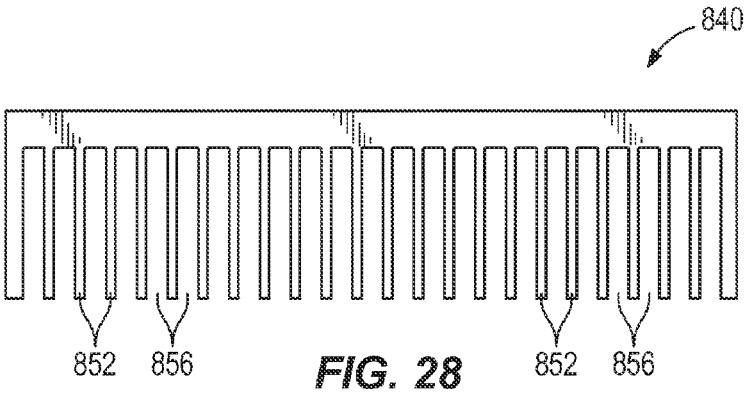
FIG. 28 is a plan view of the grooming member of FIG. 27.

The illustrated extractor 820 includes a base 824 that supports a distribution nozzle 828, a suction nozzle 832, and a brush assembly 836. The extractor 820 also includes a grooming member 840 coupled to the base 824 adjacent the distribution nozzle 828. In the illustrated embodiment, the grooming member 840 is located between the distribution nozzle 828 and the suction nozzle 832, but may alternatively be located between the distribution nozzle 828 and the brush assembly 836. The grooming member 840 extends from a lower surface 844 of the base 824 and is configured to engage a surface 848 to be cleaned. The grooming member 840 may extend across an entire width of the base 824, or may extend across a portion of the width equal to the spray area of the distribution nozzle 828. As shown in FIG. 28, the grooming member 840 includes a plurality of teeth 852 defining a plurality of gaps 856 therebetween. The teeth 852 mechanically groom or plow the surface 848 (e.g., carpet) to facilitate penetration of cleaning fluid deeper into the surface 848.

In some embodiments, such as the illustrated embodiment, the grooming member 840 may be retractable such that the grooming member 840 is spaced apart from the surface 848 when the extractor 820 is in a wash mode, but engages the surface 848 when the extractor 820 is in a sanitize mode. For example, the grooming member 840 may pivot or rotate to lay flat against the lower surface 844 of the base 824 when the extractor 820 is in the wash mode. Alternatively, the grooming member 840 may slide linearly into the base 824 when the extractor 820 is in the wash mode. In such embodiments, cleaning fluid delivered by the distribution nozzle 828 will penetrate further into the surface 848 when the grooming member 840 is extended (i.e., when the extractor 820 is in the sanitize mode) than when the grooming member 840 is retracted (i.e., when the extractor 820 is in the wash mode).

The grooming member 840 may be manually or automatically moved between retracted and extended positions when the extractor 820 switches between the wash and sanitize modes. In some embodiments, an actuator, such as a lever or dial, may be mechanically linked to the grooming member 840 to pivot or slide the grooming member 840 relative to the base 824. In other embodiments, the grooming member 840 may be electrically moved by a motor (or other suitable component of the extractor 820) between the retracted and extended positions.

In some embodiments, a surface to be cleaned may also be sanitized by pre-treating the surface with a sanitizer and then using one of the extractors described above. For example, the extractor may include a pressurized liquid spray module to dispense sanitizer onto the surface. The spray module may be battery operated, may include a hand pump, or may be an aerosol container. Alternately, the extractor may include a dry dispenser module for dispensing solid or powder sanitizer onto the surface. In such embodiments, the dry sanitizer may later be wetted by the extractor. Furthermore, the extractor may include a vaporizer module to spray sanitizer fluid onto the surface. In each of these embodiments, these modules may be stored on or part of the extractor such that the modules and the extractor are an integrated unit.

Although the invention has been described above with reference to certain preferred embodiments, variations and modifications exist within the spirit and scope of the present invention. In some embodiments, two or more of the features described above may be used in combination to implement a sanitize mode on an extractor. For example, in one embodiment, the angle of the distribution nozzle, the delivery pressure of the cleaning solution, and the recovery rate of the suction nozzle may all be varied when the extractor is in a sanitize mode. In another embodiment, the extractor may include a supply tank assembly having discrete tanks for detergent and sanitizer and two or more interchangeable suction nozzles to switch between a wash mode and a sanitize mode. Other combinations of features are also within the scope of this invention.

Various features and advantages of the invention are set forth in the following claims.

What is claimed is:

1. A floor cleaning machine for cleaning a surface, the floor cleaning machine comprising:

a body;

an actuator supported by the body;

a distribution nozzle supported by the body;

a supply tank assembly coupled to the body in fluid communication with the distribution nozzle;

a suction nozzle supported by the body;

a suction source in fluid communication with the suction nozzle, the suction source operable to draw fluid and dirt from the surface through the suction nozzle; and a recovery tank coupled to the body in fluid communication with the suction source to receive and store fluid and dirt drawn through the suction nozzle, wherein the floor cleaning machine is operable in a first mode to wash the surface, is operable in a second mode to sanitize the surface, and is operable in a third mode to rinse the surface, wherein the actuator is manually operable to switch between the first mode, the second mode, and the third mode, wherein the floor cleaning machine has a first recovery rate while in the first mode and a second recovery rate while in the second mode, wherein the second recovery rate is less than the first recovery rate, wherein the suction nozzle defines a bleed hole, wherein the bleed hole is substantially covered by a cover member when the floor cleaning machine is in the first mode, and wherein the bleed hole is open when the floor cleaning machine is in the second mode.

2. The floor cleaning machine of claim 1, wherein the body includes a foot that is movable along the surface and a handle that is pivotally coupled to the foot.

3. The floor cleaning machine of claim 1, wherein the floor cleaning machine kills at least 99% of microorganisms on the surface when operating in the second mode.

4. A floor cleaning machine for cleaning a surface, the floor cleaning machine comprising:

a body;

an actuator supported by the body;

a distribution nozzle supported by the body;

a supply tank assembly coupled to the body in fluid communication with the distribution nozzle;

a suction nozzle supported by the body;

a suction source in fluid communication with the suction nozzle, the suction source operable to draw fluid and dirt from the surface through the suction nozzle;

a recovery tank coupled to the body in fluid communication with the suction source to receive and store fluid and dirt drawn through the suction nozzle; and a lift member, wherein the floor cleaning machine is operable in a first mode to wash the surface, is operable in a second mode to sanitize the surface, and is operable in a third mode to rinse the surface, wherein the actuator is manually operable to switch between the first mode, the second mode, and the third mode, wherein the floor cleaning machine has a first recovery rate while in the first mode and a second recovery rate while in the second mode, wherein the second recovery rate is less than the first recovery rate, wherein the suction nozzle defines an opening and a flowpath extending from the opening to the recovery tank, wherein the opening is spaced a first distance from the surface when the floor cleaning machine is in the first mode, wherein the opening is spaced a second distance from the surface that is greater than the first distance when the floor cleaning machine is in the second mode, and wherein the lift member is coupled to the suction nozzle and configured to engage the surface when the floor cleaning machine is in the second mode.

5. The floor cleaning machine of claim 4, wherein a portion of the lift member is received in the opening of the suction nozzle to block a portion of the opening and to couple the lift member to the suction nozzle.

6. The floor cleaning machine of claim 4, wherein the body includes a foot that is movable along the surface and a handle that is pivotally coupled to the foot.

7. The floor cleaning machine of claim 4, wherein the floor cleaning machine kills at least 99% of microorganisms on the surface when operating in the second mode.

8. A floor cleaning machine kit for cleaning a surface, the floor cleaning machine kit comprising:

a body;

an actuator supported by the body;

a distribution nozzle supported by the body;

a supply tank assembly coupled to the body in fluid communication with the distribution nozzle;

a suction nozzle supported by the body;

a suction source in fluid communication with the suction nozzle, the suction source operable to draw fluid and dirt from the surface through the suction nozzle; and a recovery tank coupled to the body in fluid communication with the suction source to receive and store fluid and dirt drawn through the suction nozzle, wherein the floor cleaning machine is operable in a first mode to wash the surface, is operable in a second mode to sanitize the surface, and is operable in a third mode to rinse the surface, wherein the actuator is manually operable to switch between the first mode, the second mode, and the third mode, wherein the floor cleaning machine has a first recovery rate while in the first mode and a second recovery rate while in the second mode, wherein the second recovery rate is less than the first recovery rate, wherein the suction nozzle is a first suction nozzle, and further comprising a second suction nozzle having a lower recovery rate than the first suction nozzle, wherein the first suction nozzle is coupled to the body in fluid communication with the suction source and the recovery tank when the floor cleaning machine is in the first mode, and wherein the second suction nozzle is coupled to the body in fluid communication with the suction source and the recovery tank when the floor cleaning machine is in the second mode.

9. The floor cleaning machine kit of claim 8, wherein the first and second suction nozzles are interchangeably supported by the body so that the first suction nozzle is supported by the body while in the first mode, and the second suction nozzle is supported by the body while in the second mode.

10. The floor cleaning machine of claim 8, wherein the body includes a foot that is movable along the surface and a handle that is pivotally coupled to the foot.

11. The floor cleaning machine of claim 8, wherein the floor cleaning machine kills at least 99% of microorganisms on the surface when operating in the second mode.

12. A floor cleaning machine for cleaning a surface, the floor cleaning machine comprising:

a body;

an actuator supported by the body;

a distribution nozzle supported by the body;

a supply tank assembly coupled to the body in fluid communication with the distribution nozzle;

a suction nozzle supported by the body;

a suction source in fluid communication with the suction nozzle, the suction source operable to draw fluid and dirt from the surface through the suction nozzle; and a recovery tank coupled to the body in fluid communication with the suction source to receive and store fluid and dirt drawn through the suction nozzle, wherein the floor cleaning machine is operable in a first mode to wash the surface, is operable in a second mode to sanitize the surface, and is operable in a third mode to rinse the surface, wherein the actuator is manually operable to switch between the first mode, the second mode, and the third mode, wherein the floor cleaning machine has a first recovery rate while in the first mode and a second recovery rate while in the second mode, wherein the second recovery rate is less than the first recovery rate, wherein the suction source includes a motor electrically coupled to the actuator, wherein the motor operates at a first speed when the floor cleaning machine is in the first mode, and wherein the motor operates at a second speed that is less than the first speed when the floor cleaning machine is in the second mode.

13. The floor cleaning machine of claim 12, wherein the body includes a foot that is movable along the surface and a handle that is pivotally coupled to the foot.

14. The floor cleaning machine of claim 12, wherein the floor cleaning machine kills at least 99% of microorganisms on the surface when operating in the second mode.

15. The floor cleaning machine of claim 12, wherein the first recovery rate is at least 5% higher than the second recovery rate.

16. A floor cleaning machine for cleaning a surface, the floor cleaning machine comprising:

a body;

an actuator supported by the body;

a distribution nozzle supported by the body;

a supply tank assembly coupled to the body in fluid communication with the distribution nozzle; and a distributor supported by the body in fluid communication with the distribution nozzle and the supply tank assembly, the distributor including a pump electrically coupled to the actuator, wherein the floor cleaning machine is operable in a first mode to wash the surface, is operable in a second mode to sanitize the surface, and is operable in a third mode to rinse the surface, wherein the actuator is manually operable to switch between the first mode, the second mode, and a third mode, wherein the distribution nozzle is operable to deliver cleaning solution to the surface such that the cleaning solution penetrates the surface a first amount when the floor cleaning machine is in the first mode, wherein the distribution nozzle is operable to deliver cleaning solution to the surface such that the cleaning solution penetrates the surface a second amount that is greater than the first amount when the floor cleaning machine is in the second mode, wherein the distribution nozzle delivers cleaning solution onto the surface at a first pressure when the floor cleaning machine is in the first mode, wherein the distribution nozzle delivers cleaning solution onto the surface at a second pressure that is greater than the first pressure when the floor cleaning machine is in the second mode, and wherein the distributor is operable to vary a pressure of cleaning solution being delivered by the distribution nozzle between the first pressure and the second pressure.

17. The floor cleaning machine of claim 16, further comprising:

a suction nozzle supported by the body;

a suction source in fluid communication with the suction nozzle, the suction source operable to draw fluid and dirt from the surface through the suction nozzle; and a recovery tank coupled to the body in fluid communication with the suction source to receive and store fluid and dirt drawn through the suction nozzle.

18. The floor cleaning machine of claim 16, wherein the body includes a foot that is movable along the surface and a handle that is pivotally coupled to the foot.

19. The floor cleaning machine of claim 16, wherein the floor cleaning machine kills at least 99% of microorganisms on the surface when operating in the second mode.

20. A floor cleaning machine for cleaning a surface, the floor cleaning machine comprising:

a body;

an actuator supported by the body;

a distribution nozzle supported by the body;

a supply tank assembly coupled to the body in fluid communication with the distribution nozzle; and a grooming member supported by the body, wherein the floor cleaning machine is operable in a first mode to wash the surface, is operable in a second mode to sanitize the surface, and is operable in a third mode to rinse the surface, wherein the actuator is manually operable to switch between the first mode, the second mode, and the third mode, wherein the distribution nozzle is operable to deliver cleaning solution to the surface such that the cleaning solution penetrates the surface a first amount when the floor cleaning machine is in the first mode, wherein the distribution nozzle is operable to deliver cleaning solution to the surface such that the cleaning solution penetrates the surface a second amount that is greater than the first amount when the floor cleaning machine is in the second mode, wherein the grooming member is configured to be spaced apart from the surface when the floor cleaning machine is in the first mode, and wherein the grooming member engages the surface to facilitate fluid penetration into the surface when the floor cleaning machine is in the second mode.

21. The floor cleaning machine of claim 20, further comprising:

a suction nozzle supported by the body;

a suction source in fluid communication with the suction nozzle, the suction source operable to draw fluid and dirt from the surface through the suction nozzle; and a recovery tank coupled to the body in fluid communication with the suction source to receive and store fluid and dirt drawn through the suction nozzle.

22. The floor cleaning machine of claim 20, wherein the body includes a foot that is movable along the surface and a handle that is pivotally coupled to the foot.

23. The floor cleaning machine of claim 20, wherein the floor cleaning machine kills at least 99% of microorganisms on the surface when operating in the second mode.

24. A floor cleaning machine for cleaning a surface, the floor cleaning machine comprising:

a body;

an actuator supported by the body;

a distribution nozzle supported by the body;

a supply tank assembly coupled to the body in fluid communication with the distribution nozzle; and a deflector coupled to the body, wherein the floor cleaning machine is operable in a first mode to wash the surface, is operable in a second mode to sanitize the surface, and is operable in a third mode to rinse the surface, wherein the actuator is manually operable to switch between the first mode, the second mode, and the third mode, wherein the distribution nozzle is operable to deliver cleaning solution to the surface such that the cleaning solution penetrates the surface a first amount when the floor cleaning machine is in the first mode, wherein the distribution nozzle is operable to deliver cleaning solution to the surface such that the cleaning solution penetrates the surface a second amount that is greater than the first amount when the floor cleaning machine is in the second mode, wherein the deflector is configured to be positioned between the distribution nozzle and the surface when the floor cleaning machine is in the first mode, and wherein the deflector is moved away from between the distribution nozzle and the surface when the floor cleaning machine is in the second mode.

25. The floor cleaning machine of claim 24, further comprising:

a suction nozzle supported by the body;

a suction source in fluid communication with the suction nozzle, the suction source operable to draw fluid and dirt from the surface through the suction nozzle; and a recovery tank coupled to the body in fluid communication with the suction source to receive and store fluid and dirt drawn through the suction nozzle.

26. The floor cleaning machine of claim 24, wherein the body includes a foot that is movable along the surface and a handle that is pivotally coupled to the foot.

27. The floor cleaning machine of claim 24, wherein the floor cleaning machine kills at least 99% of microorganisms on the surface when operating in the second mode.

* * * * *